US006397168B1

(12) United States Patent
Plecnik et al.

(10) Patent No.: US 6,397,168 B1
(45) Date of Patent: May 28, 2002

(54) SEISMIC EVALUATION METHOD FOR UNDERGROUND STRUCTURES

(75) Inventors: Joseph Plecnik, Long Beach, CA (US); Albert F. Dorris, Edina, MN (US); Robin L. Berg, Hudson, WI (US)

(73) Assignee: Xerxes Corporation, Minneapolis, MN (US)

( * ) Notice: Subject to any disclaimer, the term of this patent is extended or adjusted under 35 U.S.C. 154(b) by 0 days.

(21) Appl. No.: 09/363,858

(22) Filed: Jul. 30, 1999

(51) Int. Cl.[7] ..... G06F 17/10
(52) U.S. Cl. ..... 703/2; 703/7; 703/10
(58) Field of Search ..... 703/2, 7, 10; 52/79.9; 220/567.2; 248/146

(56) References Cited

U.S. PATENT DOCUMENTS 5,064,155 A * 11/1991 Bambacigno et al. ..... 248/146
5,778,608 A * 7/1998 Elliott, Jr. ..... 52/79.9
6,286,707 B1 * 9/2001 Hall et al. ..... 220/567.2

OTHER PUBLICATIONS

IEEE Recommended Practices for Seismic Design of Substations, IEEE Std 693–1984, Aug. 1984, pp. 6–16.*
Pham et al., K.D. First Generation Seimic–AMD Benchmark: Robust Structural Protection by the Cost Cumulant Control Paradigm, Proceedings of the 2000 American Control Conference, vol. 1, Jun. 2000, pp. 1–5.*
Ramallo et al., J.C. Semi–Active Building Base Isolatiion, Proceedings of the 1999 American Control Conference, vol. 1, Jun. 1999, pp. 515–519.*
Thai et al., K. Structural Control via Semi–Active and Hybrid Control, Proceedings of the 1997 American Control Conference, vol. 1, Jun. 1997, pp. 6–10.*
Cadei et al., M. Simulation and Explanation of the Seimic Behaviour of Buildings Through Qualitative/Quantitative Models, Second International Conference on Intelligent Systems Engineering, Sep. 1994, pp. 70–76.*

* cited by examiner

*Primary Examiner*—Russell W. Frejd
(74) *Attorney, Agent, or Firm*—Piper Marbury Rudnick & Wolfe, LLP; Steven B. Kelber

(57) ABSTRACT

A method for modeling the behavior of an underground structure such as an underground storage tank under seismic loads includes the steps of constructing separate finite element models for the ribs, tank and fill material. The fill material model comprises a plurality of three-dimensional solid "brick" elements. The tank model comprises a plurality of three dimensional plate/shell elements. The rib model comprises a plurality of beam elements. The nodal points for the beam elements correspond to nodes defining one edge of the tank shell. The tank/rib model is preferably joined to the soil model through a plurality of radial link elements between the brick and shell elements. Spring elements may also be added for stability. A dynamic vertical or horizontal forcing function from an earth quake is then applied to the model. Stress and/or displacement results from horizontal and vertical forcing functions may then be combined if desired. The forcing functions are preferably taken from an actual earthquake, although simulated forcing functions may also be used.

27 Claims, 33 Drawing Sheets

SEISMIC EVALUATION METHOD FOR UNDERGROUND STRUCTURES

BACKGROUND OF THE INVENTION

1. Field of the Invention

The present invention is related generally to the field of modeling and more particularly to a method for modeling an underground structure such as an underground storage tank.

2. Description of the Related Art

Underground storage tanks (USES) are commonly used to store a wide variety of liquids such as gasoline. A typical UST 100 is shown in FIG. 1. The UST 100 includes a plurality of ribs 110. The UST 100 shown in FIG. 1 is a double wall UST with an inner wall 120 and an outer wall 130. Single wall as well as multiple wall USES are also used. The UST 100 may also includes a man head 140 (the man head 140 will not be modeled or discussed further herein). An installed UST is typically buried in a trench which has been backfilled with material such as sand or pea gravel.

Many of the liquids stored in USES are dangerous and/or harmful if released from a UST into the ground. Given this danger, one natural concern is that a UST be strong enough to withstand a seismic event such as a major earthquake.

One method that can be used to determine whether a UST is capable of withstanding a major earthquake is to physically reproduce earthquake conditions in the vicinity of an actual UST. However, given the size of an actual UST and/or the cost of creating UST models during the design process, as well as other factors, such methods are prohibitively expensive. A natural alternative to the aforementioned methods is the use of software modeling to predict UST behavior in an earthquake. Unfortunately, an adequate method for modeling UST behavior during earthquakes does not exist until this invention.

Different areas of the U.S. are covered by one of three different building codes. Of these, the Uniform Building Code, which is used throughout much of the western part of the country, is the dominant seismic code used throughout the U.S. and much of the world. The seismic portion of the Uniform Building Code is taken primarily from the "Blue Book," which is issued by the Structural Engineers Association of California. A review of the Blue Book indicates that buried structures are not considered within its scope of seismic analysis. Another recommendation for design of seismic structures comes from the Applied Technology Council, which is funded by the National Science Foundation. The recommendations provided in their set of publications do not address underground tanks except for a brief discussion in several of their publications. No methodology, however, is developed for analysis of such underground tanks during earthquakes. U.S. Department of Defense documents related to nuclear blast designs of nuclear silo sites, which would presumably be helpful, are mainly classified. Several Japanese publications have considered this problem, but have not addressed any specific issues or developed any specific methods.

The U.S. Department of Energy has provided some guidelines on the design of USES. Their methodology has generally been to provide an equivalent static pressure which is applied on the external surface of the tank. The tank wall stresses are then developed using hell-type or plate-type theory. Static methods such as these are inapplicable to a dynamic environment such as an earthquake.

Other types of buried systems are also discussed in the literature, including a variety of lifeline systems. Lifeline systems generally refer to long pipes or conduits, either filled or empty. Analysis of lifeline systems discussed in the literature always assumes that the lifeline is of infinite length with the seismic waves applied at various angles to the longitudinal axis of the lifeline. In the early 1980's, Owens Corning developed a seismic analysis for their underground tanks utilizing such lifeline methodology. Given the aforementioned assumptions, such methodology is not adequate for analysis of USES during seismic events such as major earthquakes.

What is needed is a method for analyzing the behavior of underground structures such as USES during seismic events such as earthquakes.

SUMMARY OF THE INVENTION

The present inventions meet the aforementioned need to a great extent by providing a method for modeling an underground structure such as a DUST which uses a finite element model in which the backfill, ribs and tank shell are separately modeled and then combined into a system model of the DUST/soil system. The backfill material is modeled using three-dimensional solid (brick) elements. The tank shell is modeled using three-dimensional plate/shell elements and the rib is modeled using beam elements. Dynamic horizontal and vertical accelerations, preferably those recorded during an actual quake such as the 1994 Northridge quake in California, are then applied as forcing functions on the system model to evaluate performance of the DUST using a time-history analysis. The method is preferably performed using a commercially available finite element analysis computer program.

BRIEF DESCRIPTION OF THE DRAWINGS

The foregoing and other advantages and features of the present inventions will be more readily understood with reference to the following figures, in which.

DETAILED DESCRIPTION

The present inventions will be discussed with reference to a preferred embodiment of a method for modeling the behavior of an underground storage tank during an actual earthquake. Numerous specific details, such as backfill material, numbers of elements in the various models, etc., are set forth in order to provide a thorough understanding of the present inventions. The preferred embodiment described herein should not be understood to limit the inventions.

Earthquake Forces

Figure 2A:
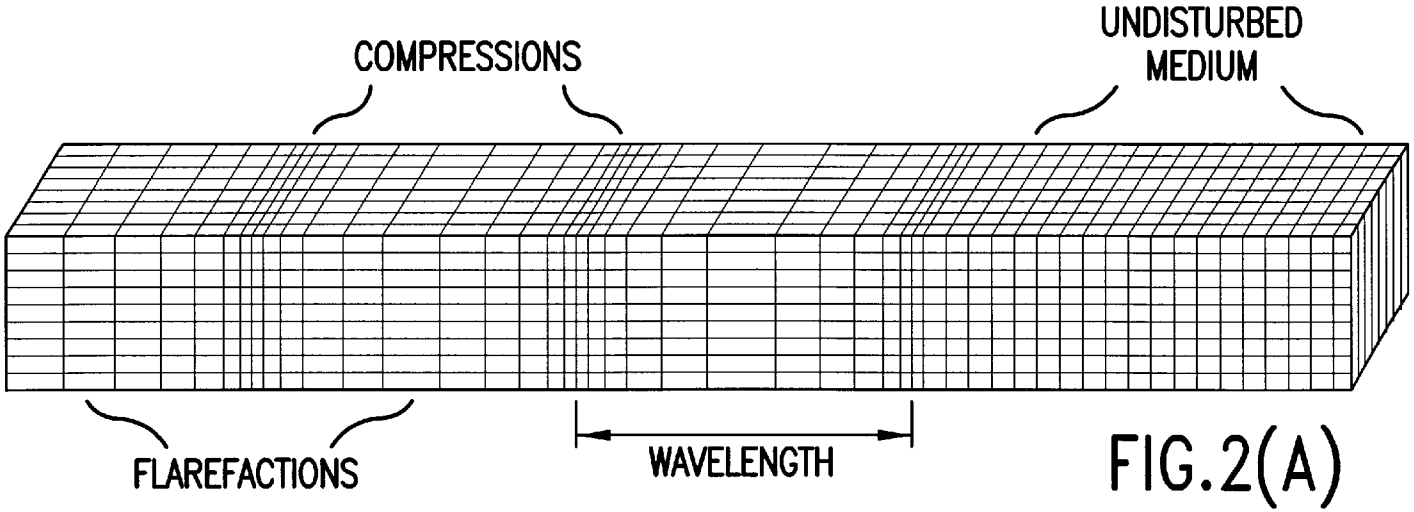
FIG. 2 is a diagram showing the effects of body waves on soil.
Figure 2B:
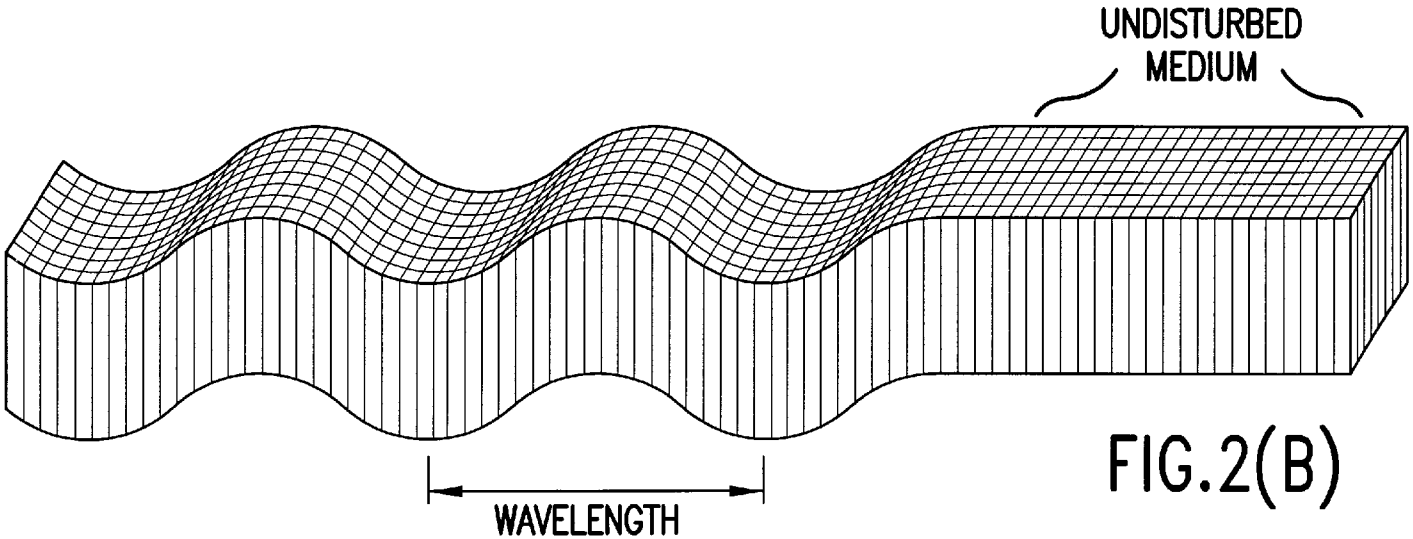

When a major earthquake occurs at some distance below the earth's surface, two types of waves are generated within the earth. These waves are generally called the "body waves." The first type are the P-waves or the so-called compression waves and are illustrated in FIG. 2. These waves do not cause permanent distortion in the in-situ soil and generate compression/tension type of behavior. As in the case of sound waves, the P-waves can travel through both solids and liquids. The second type of waves are the S-waves and are often called secondary or shear-type waves. These waves cause shear-type distortions and can only travel through solids but not liquids as liquids have no shear stiffness. The S-waves are generally divided into two groups, namely the S-V type which are in the vertical plane, and S-H type which are located in the horizontal plane.

Figure 3A:
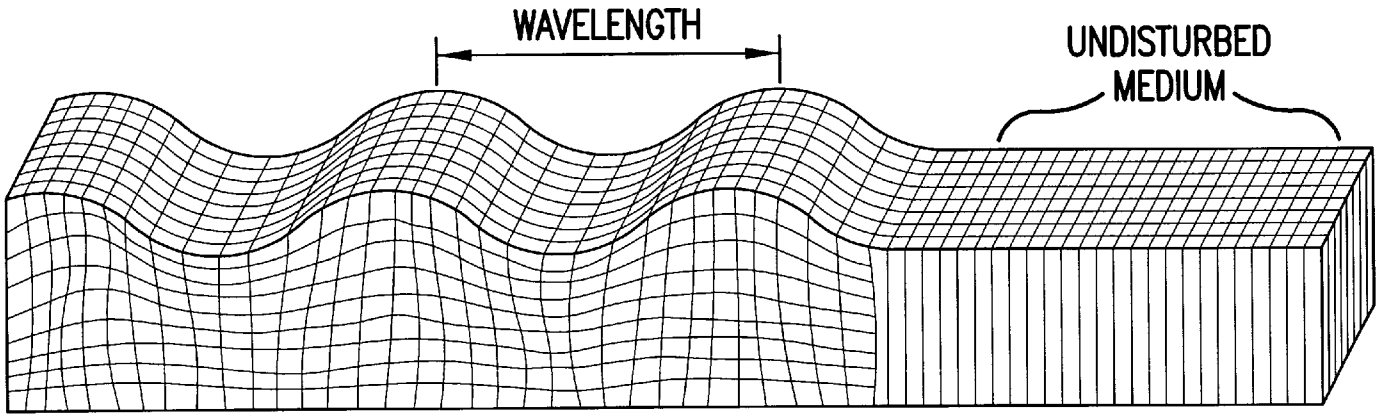
FIG. 3 is a diagram showing the effects of Rayleigh and Love waves on soil.
Figure 3B:
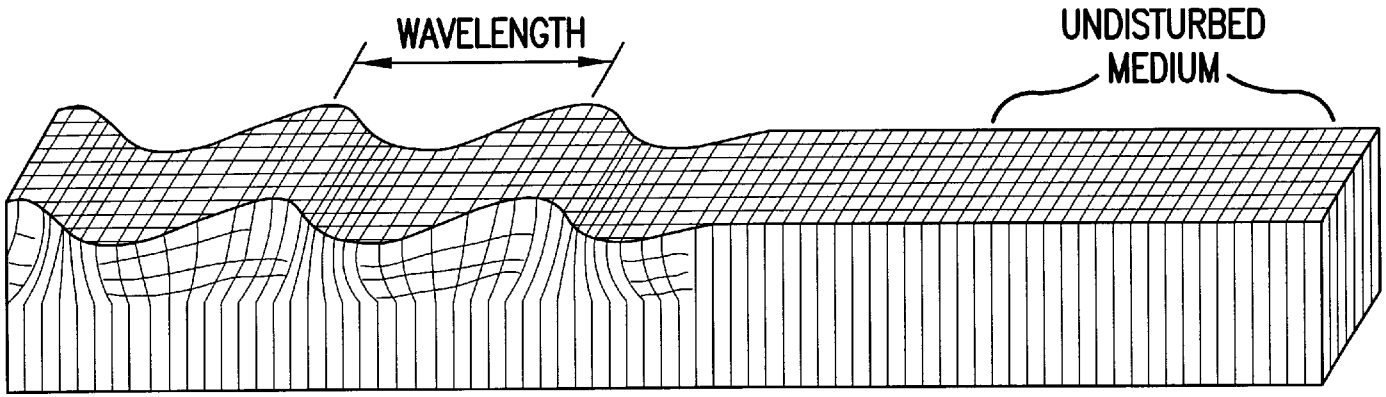

When the "body waves" travel from the epicenter of the earthquake, they will eventually intersect the surface of the earth. When such body waves do intersect the earth's surface, they form two types of waves which then travel along the earth's surface. These two sets of waves have been named differently throughout the world but in the U.S. they are generally referred to as Rayleigh waves and Love waves. The Rayleigh waves are generated when the P-waves and the S-V waves intersect the earth's surface and involve both horizontal and vertical motion of the particles on the earth's surface. FIG. 3 illustrates this phenomenon. The second type of surface wave is the Love wave, which is generated when S-H waves interact with the earth's surface. Love waves have no vertical particle motion. Love waves are generally shear type waves which will not travel through liquids or other materials with very low or zero shear stiffness. Under a negative vertical seismic acceleration equal to 1 g, the backfill material has no active confining pressure since the downward gravity is counteracted by the upward and opposite accelerations of the earthquake. With zero or low confining pressure, the shear stiffness of the backfill material becomes very low and perhaps zero. Under these conditions, the Love type waves will not impart loads onto the tank shell. Therefore, only the Rayleigh waves are considered critical in terms of loads applied on the tank shell.

In the analysis discussed herein, the horizontal and vertical accelerations, velocities and equivalent displacements are imparted on the backfill material which in turn transfers the loads onto the tank shell. It is assumed that the horizontal and the vertical seismic loads act independently of each other. Therefore, two independent sets of analyses in the horizontal and vertical directions are provided.

The significance of the low shear stiffness of the backfill material under negative vertical accelerations are accounted for by utilizing a very low dynamic shear modulus for the backfill material.

Illustrative System Dimensions and Assumptions

Figure 1:
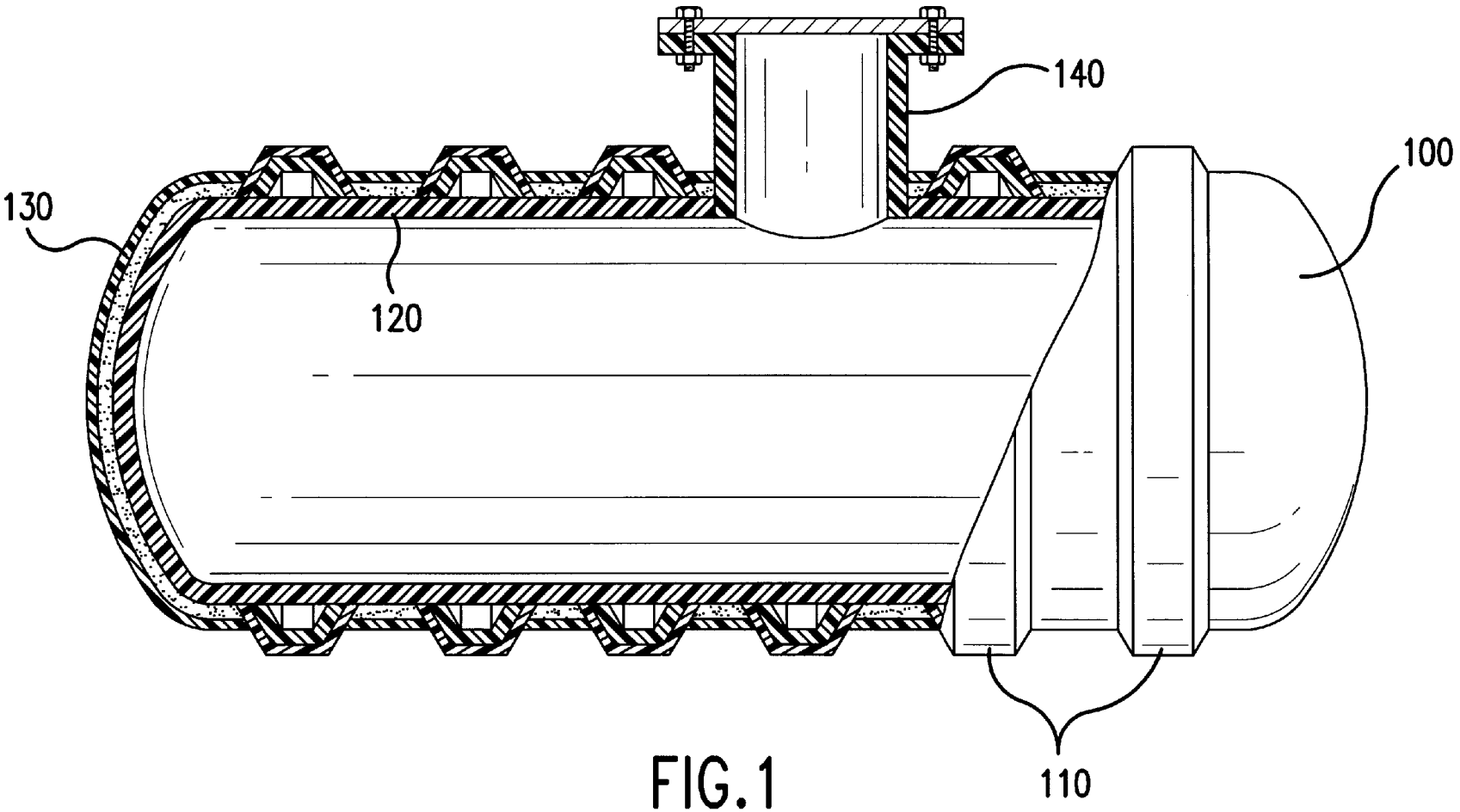
FIG. 1 is a partial longitudinal cross-sectional view of a known double-walled underground storage tank.
Figure 4:
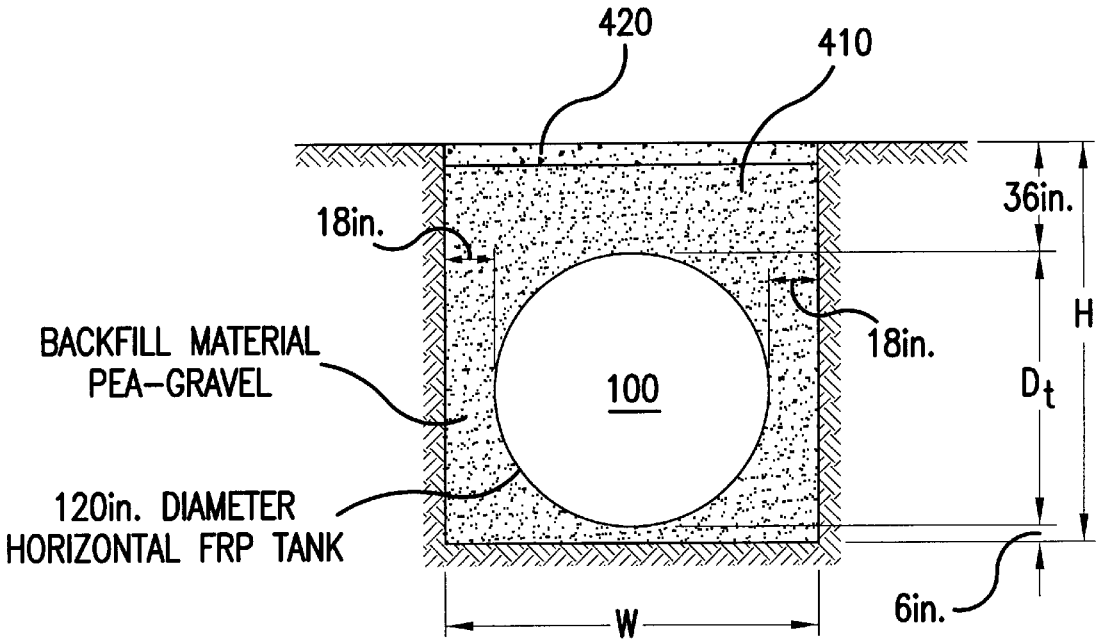
FIG. 4 is a transverse cross-sectional schematic diagram of a DUST in a backfilled trench.

The following dimensions and assumptions are set forth for the purposes of illustration only. Those of skill in the art will recognize that numerous modifications are contemplated. The UST illustrated in FIG. 1 is a double wall storage tank with a material in the interstice between the flats of the outer and inner wall, but not between the ribs. This is just one of many UST designs. Applicants' preferred design is that set forth in U.S. Pat. No. 5,720,404, commonly assigned herewith and incorporated herein-by-reference. Other multiple wall tanks, as well as single wall tanks, are known to those of skill in the art, including tanks sold in the United States and Canada. This invention is equally applicable to these designs, and single wall tanks, independent of fabrication method and design. The tanks are characterized by the presence of a cylindrical "shell" and a plurality of reinforcement or "hoop strength" ribs. As shown in FIG. 4, the UST 100 has a diameter $D_t$ of 120 inches.

The UST 100 is constructed from FRP (fiber reinforced plastic) and reinforced with ribs (not shown in FIG. 4) at 16¾ in. on centers along the entire length of the UST 100. The UST 100 is assumed to be placed in a trench 410 filled with gravel or sand. Only one UST 100 is assumed to be in the trench 410. The trench is covered by a concrete slab 420. The trench is assumed to be rectangular in cross section, with a width W that exceeds the diameter $D_t$ of the UST 100 by 36 in. (18 in. on each side), and a height H that exceeds the diameter $D_t$, of the UST 100 by 42 in. (36 in. above and 6 in. below).

Figure 5:
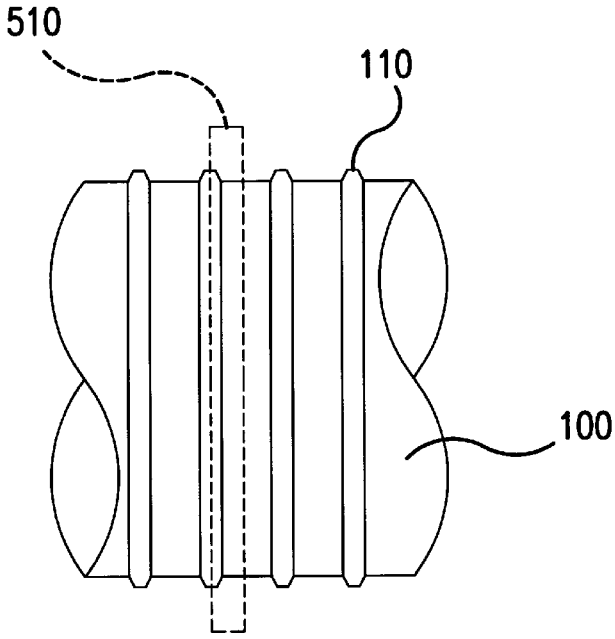
FIG. 5 is a side view of a DUST.

The UST 100 is considered long in its axial direction. Accordingly, symmetry allows the simplification of the finite element model by considering only a section 510 of the UST 100 between the center of a reinforcing rib 110 and a midpoint between that rib 110 and the adjacent one. This section 510 is shown in FIG. 5. This simplification is allowed due to Rayleigh wave lengths greater than 20 times the tank diameter.

The finite element system model includes the backfill material, the tank shell and reinforcing ribs. Direct modeling of the soil surrounding the trench is not necessary since its effect is introduced by specifying accelerations and pertinent boundary conditions.

A separate model is created for each of the backfill material, the tank shell and the reinforcing rib. The backfill material is modeled using three-dimensional solid (brick) elements, the shell is modeled using three-dimensional plate/shell elements and the rib is modeled using beam elements. After these three models are created, they are combined to form the final model of the single underground tank and trench/backfill system.

In a preferred embodiment, a record of horizontal arid vertical accelerations from the 1994 Northridge, California earthquake is utilized as the forcing function for the dynamic analysis of the model. Actual acceleration data from other earthquakes or simulated data could be used as well.

Soil Backfill Model

Figure 6:
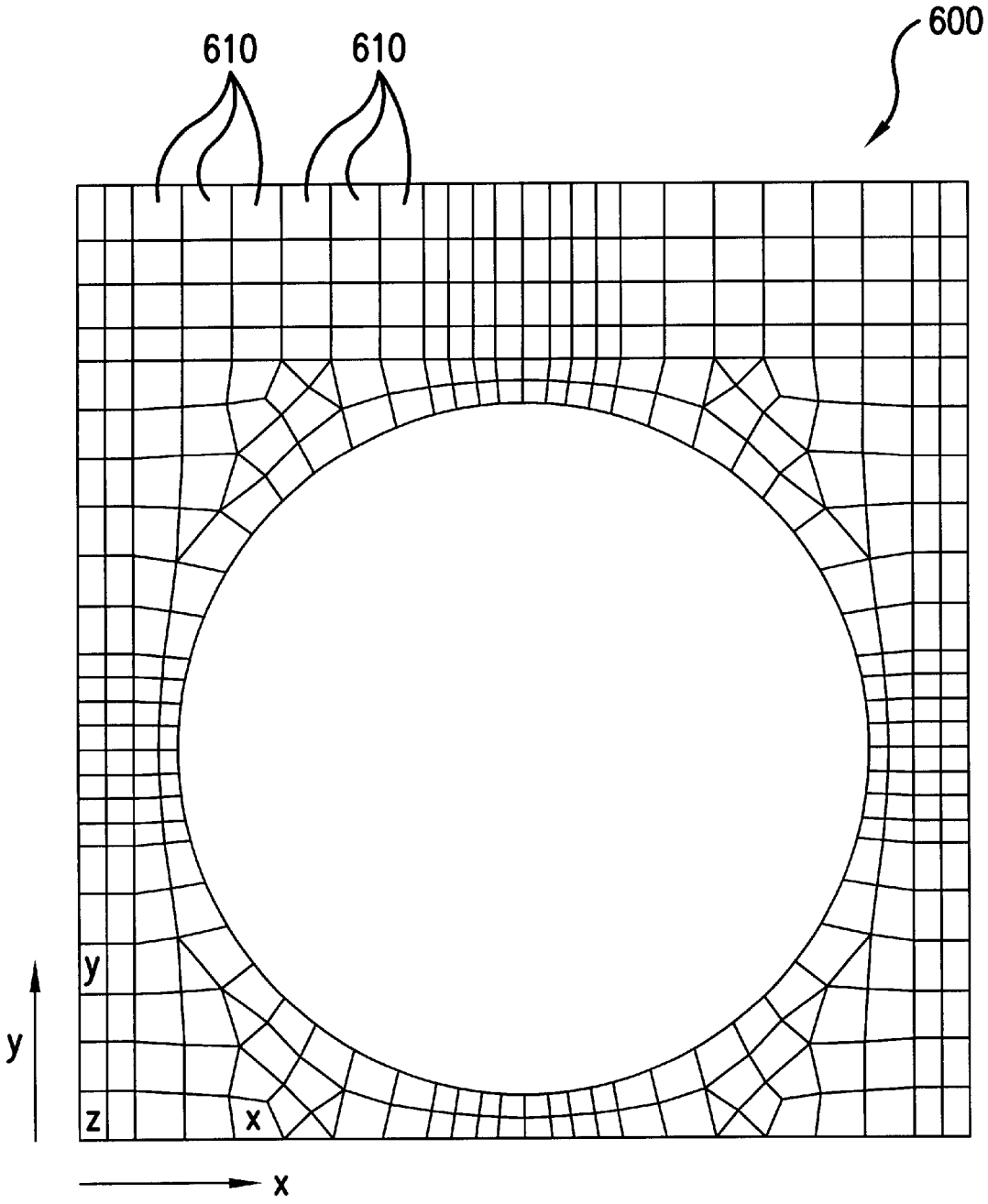
FIG. 6 is a transverse cross-sectional view of a finite element model of backfill material according to one embodiment of the present invention.
Figure 7:
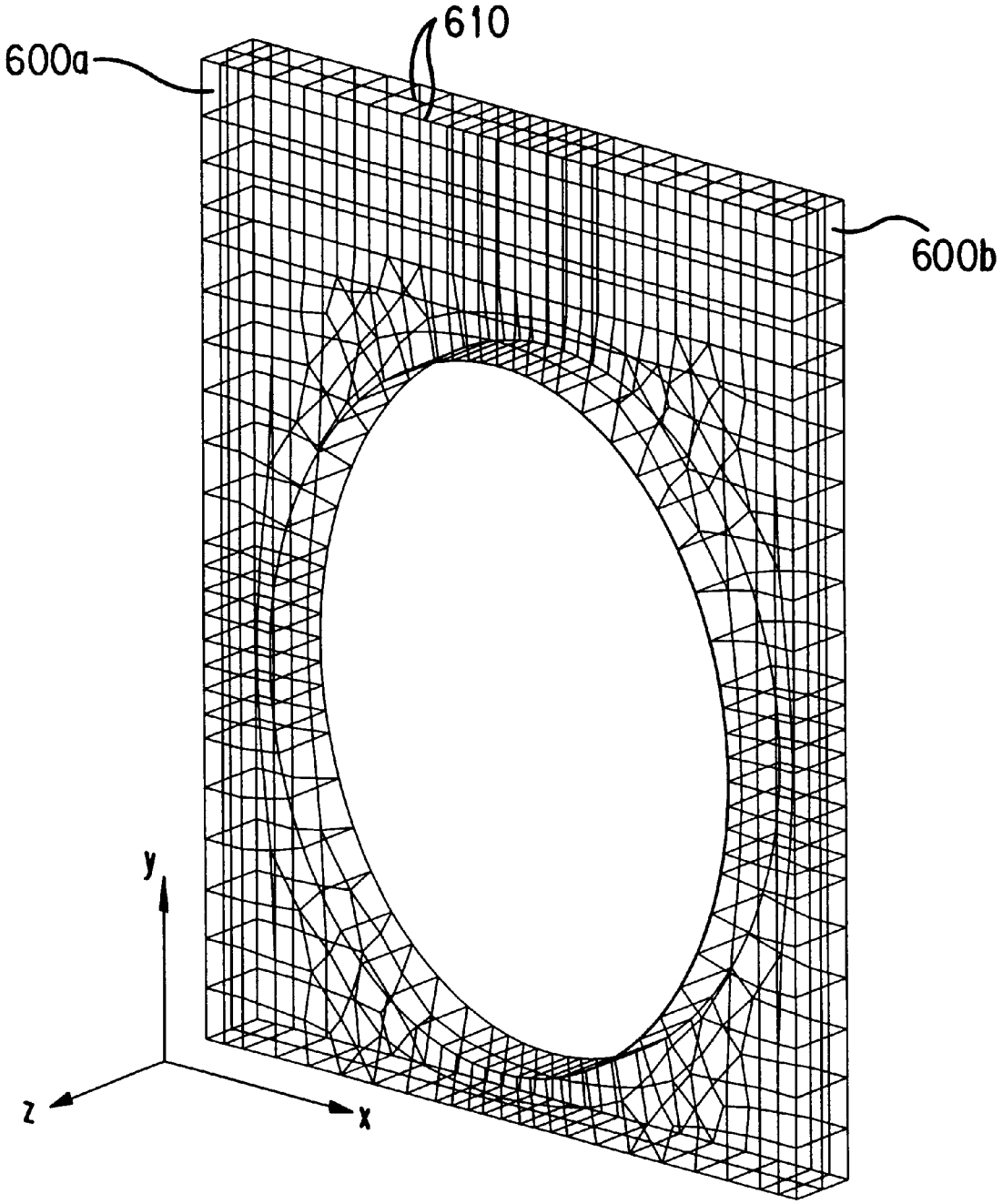
FIG. 7 is a perspective view of a finite element model of the backfill material of FIG. 6.

The backfill gravel material is modeled using only three-dimensional solid elasticity "brick" elements 610 as shown in FIG. 6. Each element 610 is defined in space by eight nodes. All brick elements consist of straight edges and plane faces. The boundaries of the model are determined both by the shape of the trench and by the cross section of the underground tank. FIG. 6 shows the geometry of the backfill model and the finite element mesh 600 in the plane of the tank's transverse cross-section (x-y plane). This view shows only 352 brick elements, which is one half the total number of elements. Two identical layers 600*a*, 600*b* of brick elements 610, as shown in FIG. 7, are utilized, each element 610 having a 4³⁄₁₆ in. uniform depth in the axial (z) direction. The total number of brick elements in both layers is 704 and the total thickness of the model is 8⅜ in., which is half the distance between two reinforcing tank ribs (due to assumed symmetry). This data is representational only. Actual adjustments will be made for actual tank construction and spacing.

The cross-sectional dimensions of the trench containing the underground tank determine the outer boundary of the backfill model in the x-y plane. The base of the trench is 36 in. wider than the tank diameter $D_t$ to provide a clearance of 18 in. at the springline on either side of the tank between the vertical walls of the trench 410. For a 120 in. diameter tank 100, the trench dimensions, and therefore the backfill outline dimensions, are 156 in. And 162 in. (base and height respectively) as shown in FIG. 4.

Isotropic material properties are assumed for all brick elements. However, determination of the soil properties for this problem are both complex and very significant. Large variations of soil dynamic properties are encountered throughout the limited literature available for gravel and gravelly soils. It is widely accepted that dynamic soil modulii and damping may vary significantly during a dynamic event such as an earthquake for any type of soil. Among the soil characteristics that have significant influence on the dynamic properties of gravels are the effective confining mean stress ($\sigma_0$), grain size, void ratio (e), and level of shear strain ($\gamma$). For a specific type of gravel and an effective mean stress, shear modulus decreases with increasing level of cyclic shear strain, whereas damping increases with increasing level of shear strain. In a preferred embodiment, the material properties for each individual model of the backfill are assumed constant during the entire time-history forcing function. This assumption is reasonable and greatly simplifies modeling; not making this assumption makes modeling much more difficult since the soil stiffness is greatly affected by the confining pressure at each point in the model.

Figure 8A:
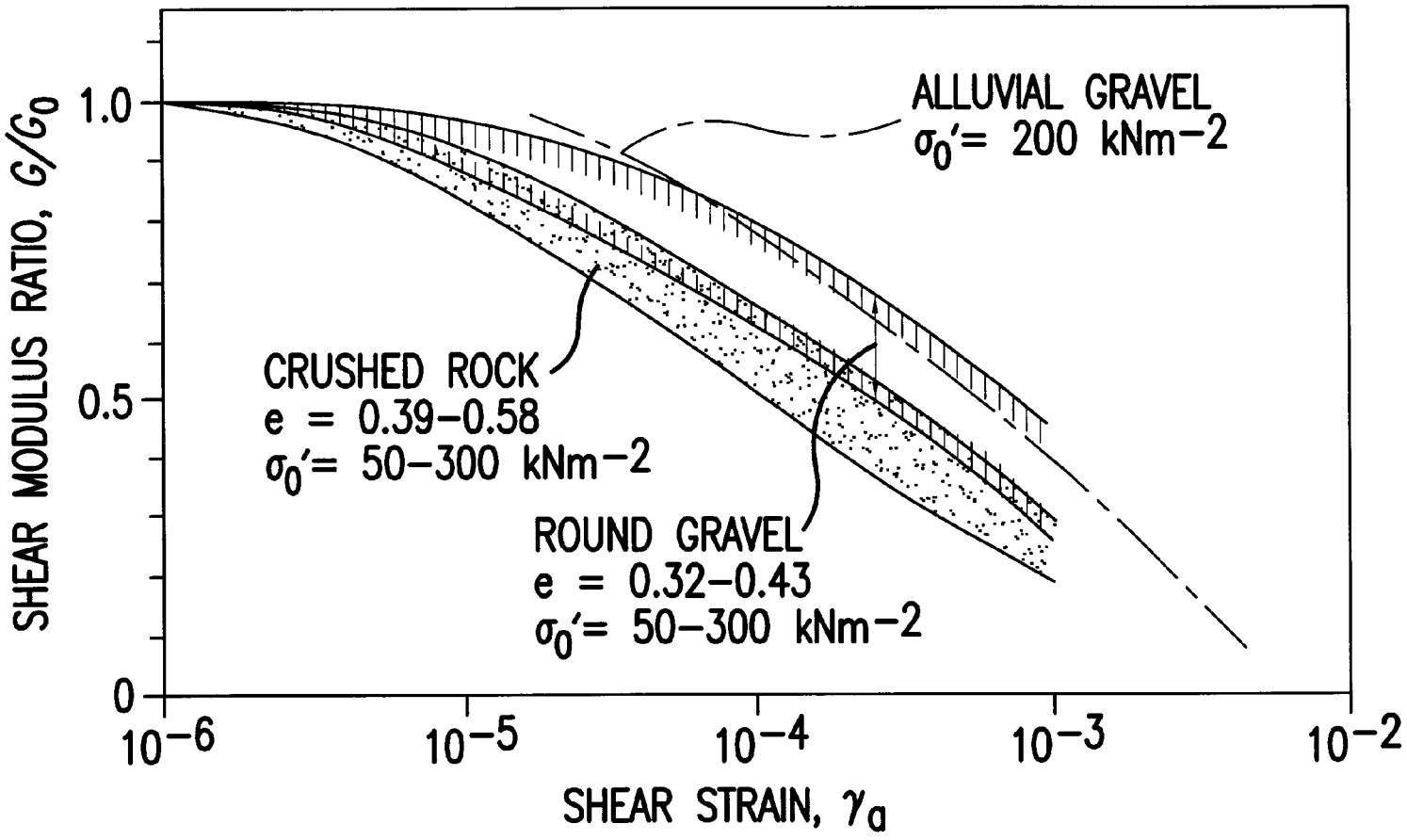
FIG. 8(A) is a plot of the shear modulus ratio as a function of shear strain for various backfill materials.
Figure 8B:
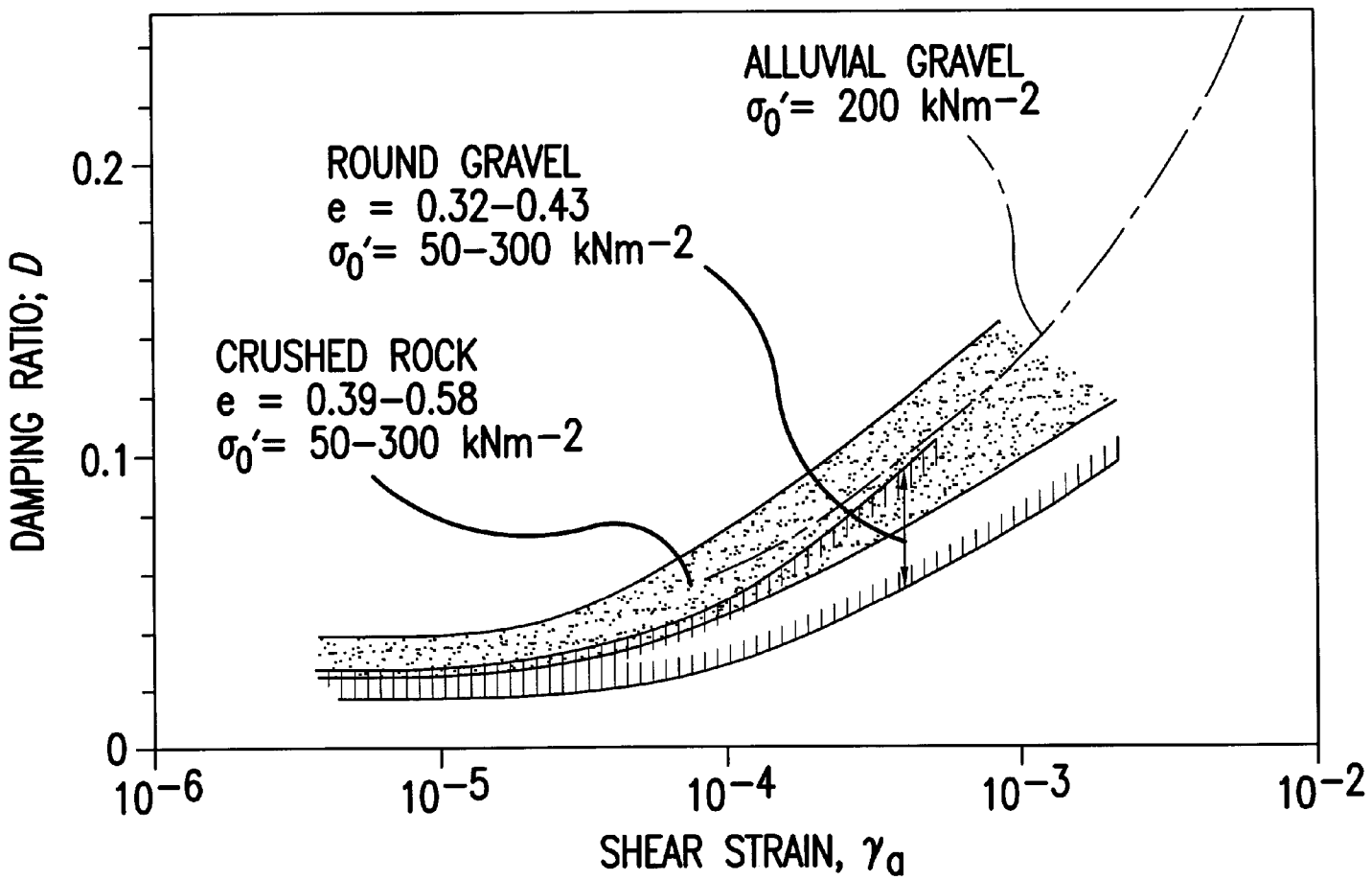
FIG. 8(B) is a plot of the damping ratio as a function of shear strain for various backfill materials.
Figure 9:
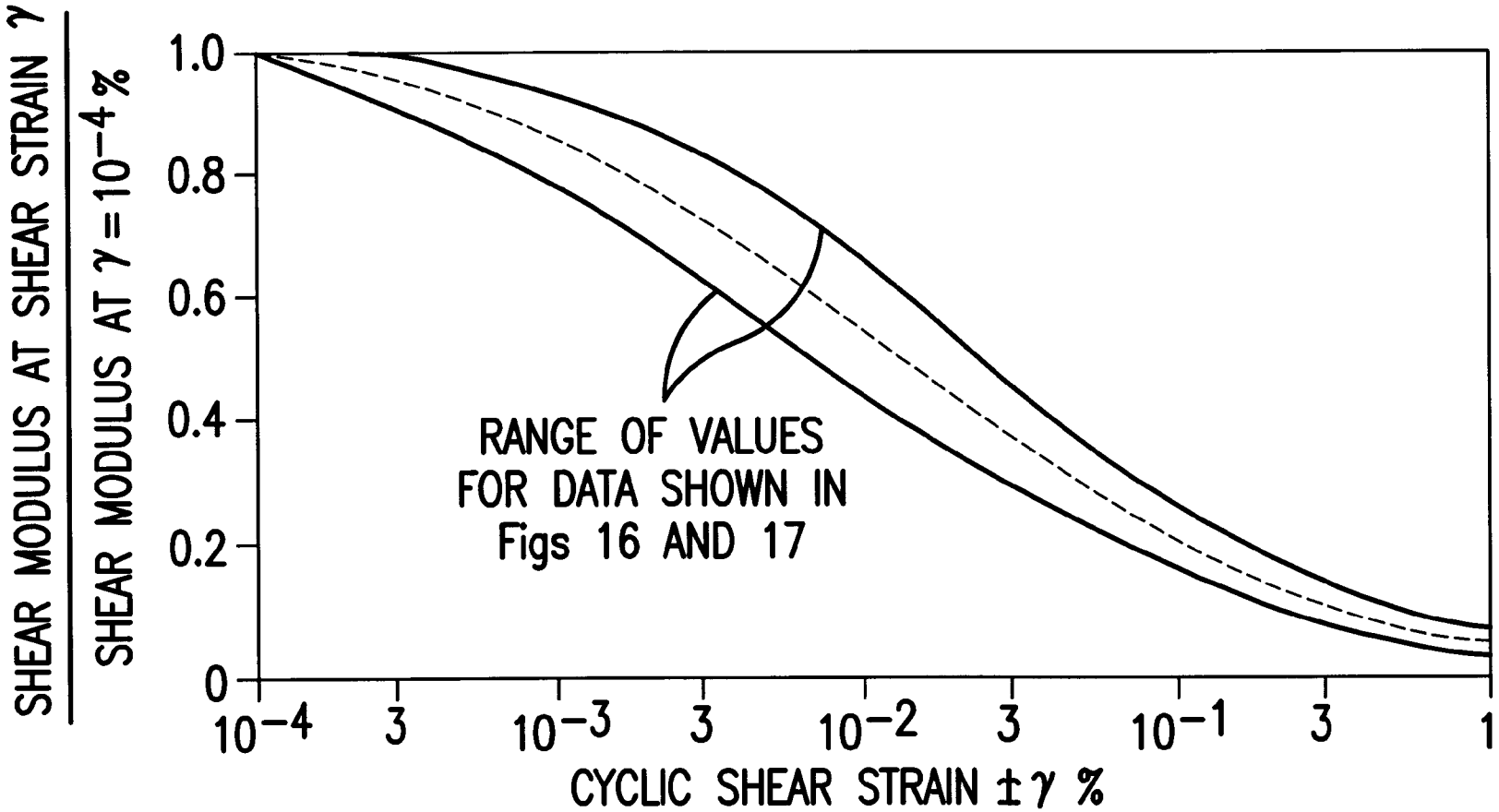
FIG. 9 is a plot of the shear modulus ratio as a function of shear strain for gravelly soils.
Figure 10:
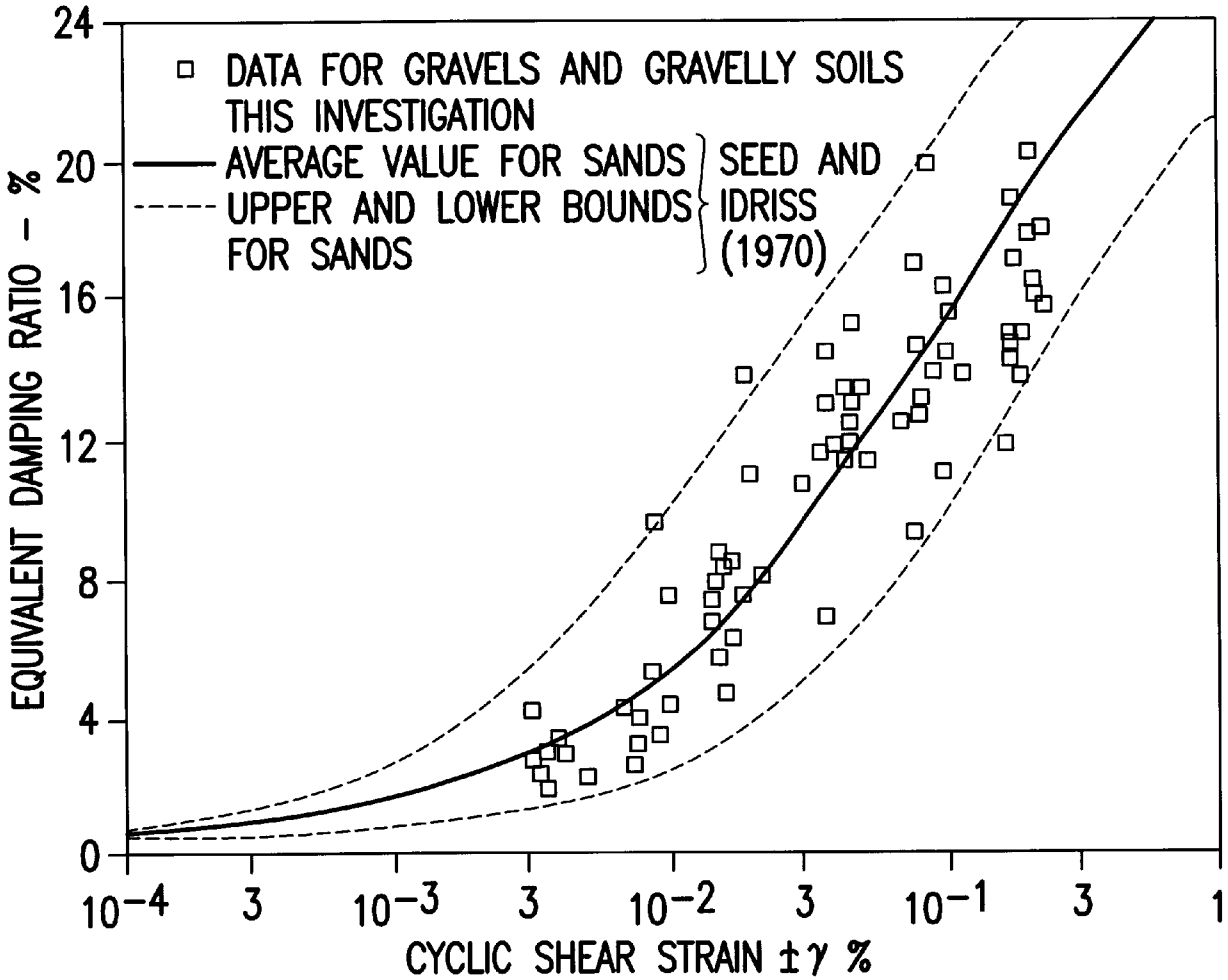
FIG. 10 is a plot of the damping ratio as a function of shear strain for soils and sands.

Shear modulus measured at very low levels of cyclic strains is called the initial shear modulus, $G_0$. It is common practice to measure this modulus at strains in the order of $10^{-4}$ to $10^{-6}$ percent. This initial modulus is only a reference for dynamic problems that involve larger strains, such as a major earthquake event. Therefore this modulus must be reduced according to the actual expected strain by using an "attenuation" curve obtained from published test results. FIG. 8 shows the results of a study by Kokusho (1980) on shear modulus (FIG. 8A) and damping (FIG. 8B) at various strain levels. These results indicate the tendency of dynamic shear modulus to decrease with increasing strain. The tendency for the damping ratio is to increase with increasing strain level as noted earlier. A study by H. B. Seed (1986) also shows the same tendencies of modulus and damping, which are illustrated in FIGS. 9 and 10, respectively.

For round gravel such as the pea gravel commonly used as backfill material, the following is an empirical expression derived by Kokusho and Esashi (1981) to evaluate $G_0$:

$$G_0 = \frac{8400(2.17 - e)^2(\sigma_0)^{0.60}}{(1 + e)} \tag{1a}$$

where $G_0$ and $\sigma_0$ are in KPa.

In English units, the previous equation becomes:

$$G_0 = \frac{3880(2.17 - e)^2(\sigma_0)^{0.60}}{(1 + e)} \tag{1b}$$

where $G_0$ and $\sigma_0$ are in psi.

This expression is used to estimate $G_0$ for the gravel backfill material. The $G_0$ is modified to obtain the shear modulus G by applying a factor ($G/G_0$) obtained from a shear modulus attenuation curve. The curve used for round gravel from FIG. 8 shows that the factor ($G/G_0$) can drop to very low values for high levels of strain. It is reasonable to expect high levels of strains and consequently low values of soil shear modulus during a major earthquake as discussed above. To evaluate the effect of different values, separate analyses may be performed. In one preferred embodiment, expression (1a) is utilized to evaluate $G_0$ and a factor of 0.15 is used for ($G/G_0$). This results in the following expression for the shear modulus G, where G and $\sigma_0$ are in psi:

$$G_0 = \frac{582(2.17 - e)^2(\sigma_0)^{0.60}}{(1 + e)} \tag{2}$$

In this embodiment, G is evaluated at different depths assuming a void ratio of 0.4 and a soil weight $\gamma$ of 120 pcf. The effective confining mean stress is affected by the vertical seismic accelerations which alter the effective weight of the soil. Upward accelerations will reduce the confining mean stress and thus reduce the value of the shear modulus G. Therefore, the confining soil pressure $\sigma_0$=0.375 $\gamma$ H is chosen for this embodiment. This results in a G that varies from 360 psi for the brick elements at the upper surface to 2,257 psi for the brick elements at the tank's mid-height. All brick elements below the tank's mid-height are assigned a constant shear modulus of 2,257 psi. This assumption is made to account for the fact that directly under the tank, the effective pressure in the gravel will not be influenced by the total soil height as it would be if the tank were not present.

The Young's modulus of elasticity, E, is calculated with the expression:

$$E=2G(I+v) \tag{3}$$

where $v$ is the Poisson ratio, which is taken as 0.4 for the gravel. This Poisson ratio results in E values in finite element models of 1,008 psi at the upper surface to 6,320 psi at the tank's mid-height level and below. In another preferred embodiment, a range of acceptable probable values are assigned to the dynamic shear modulus G. The modulus of elasticity is evaluated with expression (3).

Tank Shell Model

The tank shell is modeled with three-dimensional thin plate/shell type elements. A total of 128 elements with a 5/16 in. thickness are used to model the complete ring. This ring is taken from the center of a reinforcing rib to half way between two adjacent ribs. Each finite element is defined with four corner nodes that are placed 60 in. away from the tank's longitudinal axis to result in shell diameter of 120 in.

The plate elements' nodal points are offset a distance of approximately 0.1 in. in the radial direction with respect to the brick elements' nodal points. The purpose of this gap is to introduce axial spring type elements joining the backfill soil and the tank shell so that tangential forces between the backfill and the tank shell are minimized.

Figure 11:
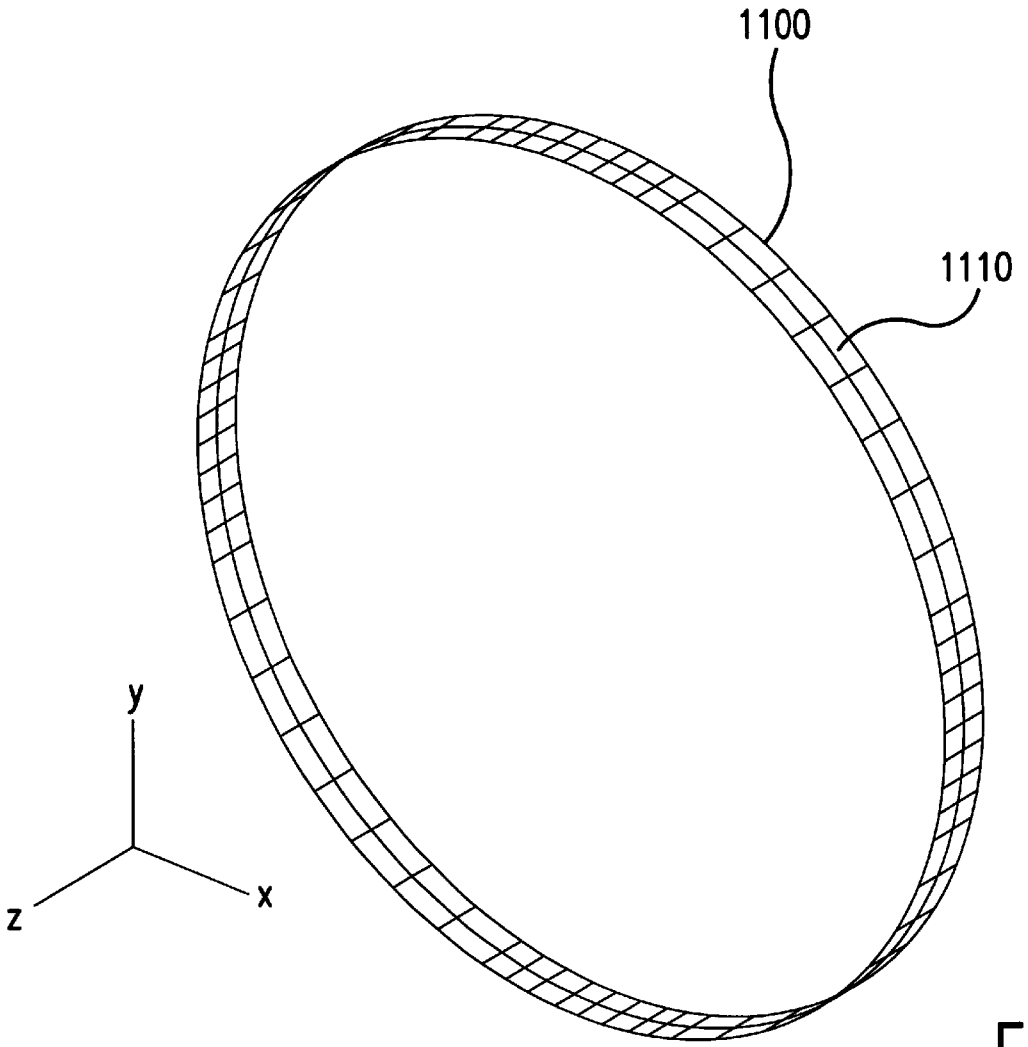
FIG. 11 is a perspective view of a finite element model of a tank shell according to one embodiment of the present invention.

A perspective view of the finite element mesh 1100 for the tank shell in the preferred embodiment is shown in FIG. 11. 64 plate elements 1110 are used around the circumference (x-y plane) and two elements in the tank's axial direction (z axis). In the circumferential direction, the sides of the elements have lengths of either 3.9 in. or 7.8 in. In the axial direction, all elements have sides of 4 3/16 in. The total length of the model in the axial direction is 8⅜ in., which is the half distance between the tank reinforcing ribs 110. Again, these values may be adjusted as appropriate.

Isotropic material properties are specified for all plate elements in the preferred embodiment. The following fiberglass properties are specified for all plate elements:

E=Modulus of elasticity=900,000 psi

ν=Poisson's ratio=0.3

G=Shear Modulus=E/[2(1+ν)]

With respect to the weight density of the plate elements, two different types of finite element models are created. In one case, the normal weight of FRP is given to all the elements without any modification. This case represents the condition of an empty tank. The weight is specified as 0.061 $lb/in^3$ (pci).

Figure 12:
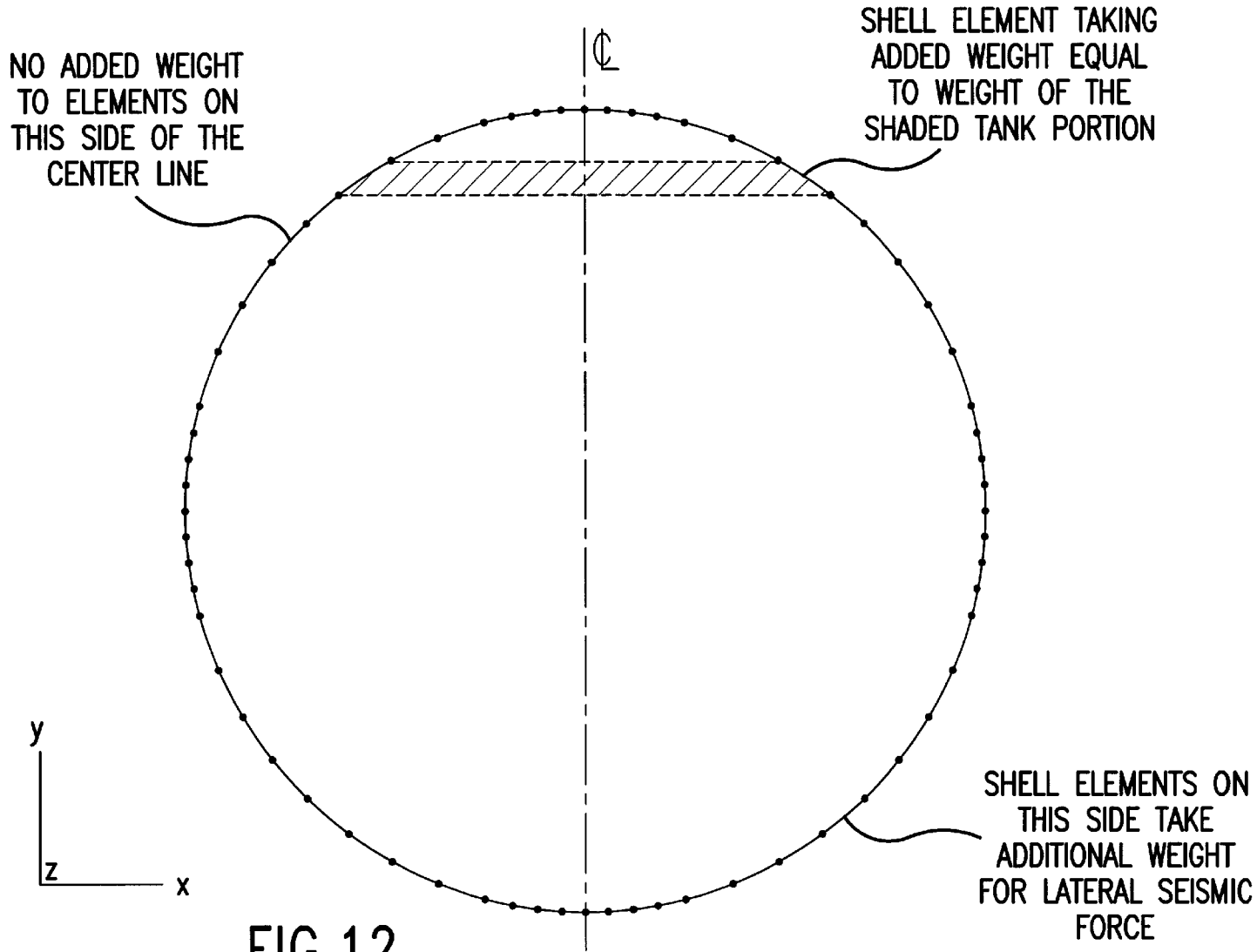
FIG. 12 is a side view of the finite element model of FIG. 1.

A second case represents the effect of the additional inertia introduced when the tank is completely full. Under lateral seismic loading, it is assumed conservatively that the tank content weight is transferred entirely to the shell elements located on only one side of the tank with respect to its vertical plane of symmetry. The added weight is distributed to these elements in proportion to their tributary content volume as shown in FIG. 12, and included as additional weight density to the shell assuming a plate thickness of ¼ in. for all the elements. A density of 0.75 is assumed for the tank content in the calculations. This adjustment resulted in weight densities, for elements on the modified side of the tank shell, that varied increasingly from 0.083 pci at the top and bottom of the tank to 10.40 pci at the tank's mid-height. The plate elements on the other side of the tank are assigned the normal FRP weight of 0.061 pci as for the previous case.

Tank Rib Model

Figure 13:
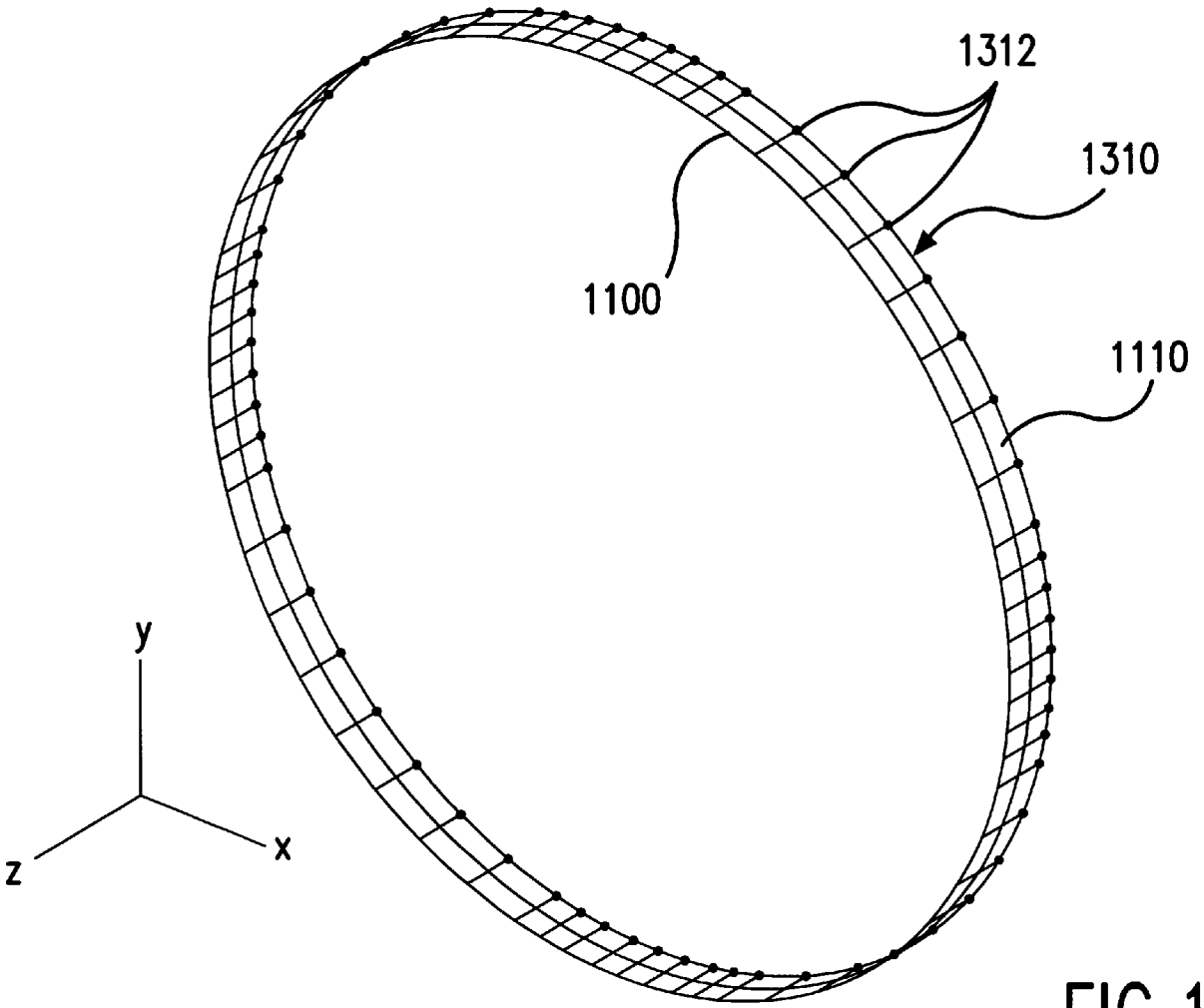
FIG. 13 is a perspective view of a finite element model of a tank rib according to one embodiment of the present invention.

Because this model takes advantage of symmetry with respect to a plane (x-y plane) passing through the center of a reinforcing rib, only one half of the tank rib contributes to the stiffness of the model. Therefore, these properties correspond numerically to one half the properties of a complete rib. A total of 64 beam elements 1310 are used at the perimeter of the tank shell 1100 as shown in FIG. 13. The nodal points 1312 for the elements 1310 correspond to nodes defining one edge of the tank shell.

The following centroidal cross-sectional properties are utilized in a preferred embodiment for all beam elements that define the (one-half) rib:

A=Cross-sectional area=3.25 $in.^2$

I=Flexural moment of inertia=4.0 $in.^4$

S=Section modulus=2.35 $in.^3$

The following are the pertinent material properties used for the preferred embodiment:

E=Modulus of elasticity=900,000 psi

ν=Poisson's ratio=0.3

The weight density, which is very small and has no effect in the overall behavior of the system, is assigned a value of 0.061 pci. in the preferred embodiment. Static rather than dynamic fiberglass material properties of the tank shell are used in the preferred embodiment since the strain rates are relatively low. Again, these values are drawn from actual USES and materials considered. Other values may be substituted as appropriate.

Joining the Models by Link Elements

As explained above, a gap of approximately 0.1 in. is left between the brick elements (backfill material) and the plate/shell elements (tank shell). Both models are joined by introducing a total of 192 radial link elements (axial stiffness of 100,000 lb./in.) between the brick and shell elements. In addition, 3 spring elements that have a tangential component with respect to the tank's circumference are added to make the model stable. These three elements have low stiffness and have no significant effect on results. Those of skill in the art will recognize that many different schemes for joining, either directly or indirectly, the shell model, the rib model and the backfill material model are possible.

Concrete Slab Model

For purposes of analysis of vertical seismic accelerations, the weight and rigidity of the concrete slab 420 is considered in the finite element model. The effect of the concrete weight is to increase the confining pressure of the soil which, therefore, affects the backfill dynamic properties.

The concrete slab on top of the soil is modeled using plate elements. These elements are given properties equivalent to a 6 in. thick concrete slab reinforced with No. 5 steel bars at 12 in. cc. The thickness of the plate elements (4.86 in.) is determined based on a flexural rigidity of the concrete slab equal to the average between the gross-section properties and the cracked-section properties. The weight density of the plate elements (0. 107 pci) is determined based on a concrete weight of 150 pcf. For systems using other slabs, or differing features, appropriate numbers for modeling will be introduced.

Boundary Conditions for Horizontal Seismic Loading Case

Boundary conditions are applied to the model both to satisfy symmetry conditions and to include the effect of soil surrounding the trench and backfill material. Rigid boundary conditions are used to account for symmetry about two planes that are parallel to the x-y plane. One of these planes passes through the center of a reinforcing rib and the other passes through the midpoints between two adjacent tank ribs. Translational degree of freedom along the axial direction (z-axis) is restrained on all nodal points within these planes for brick and plate elements. Translations in the x-y planes are free for all nodes except the nodes defining the boundary between the backfill material and the adjacent soil and the top of the concrete slab. By definition, brick elements have no active rotational degree of freedom. Besides the boundary conditions mentioned above, rotation is also restrained for the plate/shell element nodes contained within the planes of symmetry mentioned above. At these nodes, plate elements are restrained from rotating about the x-axis and the y-axis. They are free to rotate about axes parallel to the tank's axial direction.

At the top and bottom boundaries of the backfill model, all nodes are free to translate in the horizontal direction (x-direction) perpendicular to the tank longitudinal direction. Therefore, these nodes of the brick elements are restrained by a boundary equivalent to rollers at the bottom between the backfill and the supporting soil, and at the top between the backfill and the concrete slab.

On the vertical boundaries (parallel to the y-z plane) of the trench, two different types of boundary conditions are utilized. These boundaries are defined by nodes at the contact area between the backfill material (brick elements) and the surrounding soil (not modeled). On one side of the model, these nodes are completely restrained with respect to both translational and rotational degrees of freedom using rigid boundary conditions. This is the side of the trench where the lateral seismic acceleration input is applied to perform the time-history analysis as explained further below.

On the vertical wall opposite to the fixed side, the interaction between backfill and surrounding soil is introduced with the use of elastic boundary elements. These elements introduce only translational restraints in the horizontal x-direction. A total of 75 elements are utilized in the preferred embodiment with a spring constant calculated as the product of the tributary area of the respective node and a soil constant of 100 pci.

Boundary Conditions for Vertical Seismic Loading Case

Boundary conditions applied for the vertical accelerations are similar to those applied for the horizontal accelerations, with only the following modifications:

1. The bottom nodes, which define the bottom of the trench, are completely restrained or fixed. This type of restraint is necessary so that the vertical accelerations can be applied at the base of the trench.
2. The nodes defining the sides of the trench are restrained in all translations and rotations, except for the vertical translation. This condition allows the entire model to displace up and down.
3. The top nodes, which define the contact surface between the soil and the concrete slab, are restrained from translating only in the axial direction of the tank (Z-axis). The only rotational unrestrained degree-of-freedom is the rotation about the Z-axis.

Dynamic Analysis for Horizontal Seismic Loads

In one preferred embodiment, the Direct Integration Algor Processor (SSAP4) is used to perform the time-history analysis of the underground tank system model described above subjected to the affect of horizontal seismic accelerations. This processor performs a direct step-by-step integration of the equations of motion for a time varying ground acceleration forcing function. This function is specified as a number of discrete data points of acceleration (in./s$^2$) acting in the horizontal x-direction versus time (s). The nodal points acted upon by the function are the fixed nodes on one of the two vertical surface boundaries between the backfill material and the soil (not modeled) that surrounds the trench, as described in the section for boundary conditions. These nodes are the reference from which all relative displacements are evaluated elsewhere within the model. Therefore, the resultant relative displacements of the nodes where the acceleration function is applied are all zero.

The arrival time (the time when the acceleration function is assumed to start acting) is time zero. Zero initial displacements and velocities are assumed at time zero. Therefore, the entire structure is assumed to be at rest when the dynamic load input starts. A stiffness matrix damping coefficient of 10% is used in this exemplified preferred embodiment.

For this example, actual dynamic load data, such as the mainshock of the Northridge, Calif. earthquake, is selected for load input data. The Northridge earthquake occurred on Jan. 17, 1994. It originated about 18.5 miles west-northwest of downtown Los Angeles at a focal depth of approximately 12 miles. A moment magnitude $M_w$ of 6.7 has been reported for the earthquake. A large number of strong-motion records were obtained during this earthquake. The record utilized for this example is part of the ground-response records processed by the California Strong-Motion Instrumentation Program (CSMIP). This record corresponds to the Tarzana-Cedar Hill Nursery A Station located near the crest of a low (65 ft.), natural hill approximately 3 miles south of the estimated epicenter. Horizontal accelerations corresponding to channel 1 (90 degrees) are used as input for the dynamic analysis. Instrument-corrected peak values and initial values for this channel are the following:

Peak acceleration: 1.78 g at 8.36 sec.

Peak velocity: −47.370 in./sec at 8.34 sec

Peak displacement: 11.477 in. at 7.920 sec

Initial velocity: 0.670 in./sec

Initial displacement: 1.730 in.

The first 15 seconds of the acceleration time-history are used in this example. Data beyond the first 15 seconds is not necessary since the peak values occur at approximately 8 secs. A total of 750 points are given to define the function. Every point corresponds to an acceleration every 0.02 sec. A linear interpolation between points is performed to define the complete input function. The output may be requested every 10 time stops or every 0.20 secs.

Dynamic Analysis for Vertical Seismic Loads

The dynamic analysis for vertical seismic loads is performed using the same program (SSAP4) and technique as described for the case of horizontal seismic loads. However, for the case of vertical accelerations, the dynamic input is applied at the nodal points defining the bottom of the trench. As for the vertical case, the entire system is assumed to be at rest at time zero when the dynamic input starts. A stiffness matrix damping coefficient of 10% is used in the preferred embodiment.

The dynamic analysis for vertical accelerations is performed using the vertical ground accelerations of the Tarzana-Cedar Hill Nursery Station recorded during the same Northridge earthquake. The instrument corrected peak values and initial values for the vertical (up) channel are the following:

Peak acceleration: 1.047 g at 8.58 sec.

Peak velocity: −28.469 in./sec. At 8.52 sec.

Peak displacement: 6.700 in. at 7.94 sec.

Initial velocity: −0.530 in./sec.

Initial displacement: 1.944 in.

Again, only the first 15 seconds of the vertical acceleration file history are used in the preferred embodiment since peak values occur between 8 and 8.5 seconds. Accelerations start decreasing after 8.5 seconds and they are relatively low after 15 seconds. To define the 15 second history, a total of 750 data points are input every 0.20 seconds.

As noted earlier, the vertical and horizontal analyses are performed independently of each other. If desired, the horizontal and vertical results from the model can be algebraically added. However, such algebraic addition will result in the absolute maximum possible displacements and stresses. The results obtained with the model for the horizontal and vertical seismic loads will not only occur at different locations but may also occur at different time periods within the time-history of the earthquake motion. Thus, a direct algebraic addition of results may be overly conservative.

Results

Figure 14A:
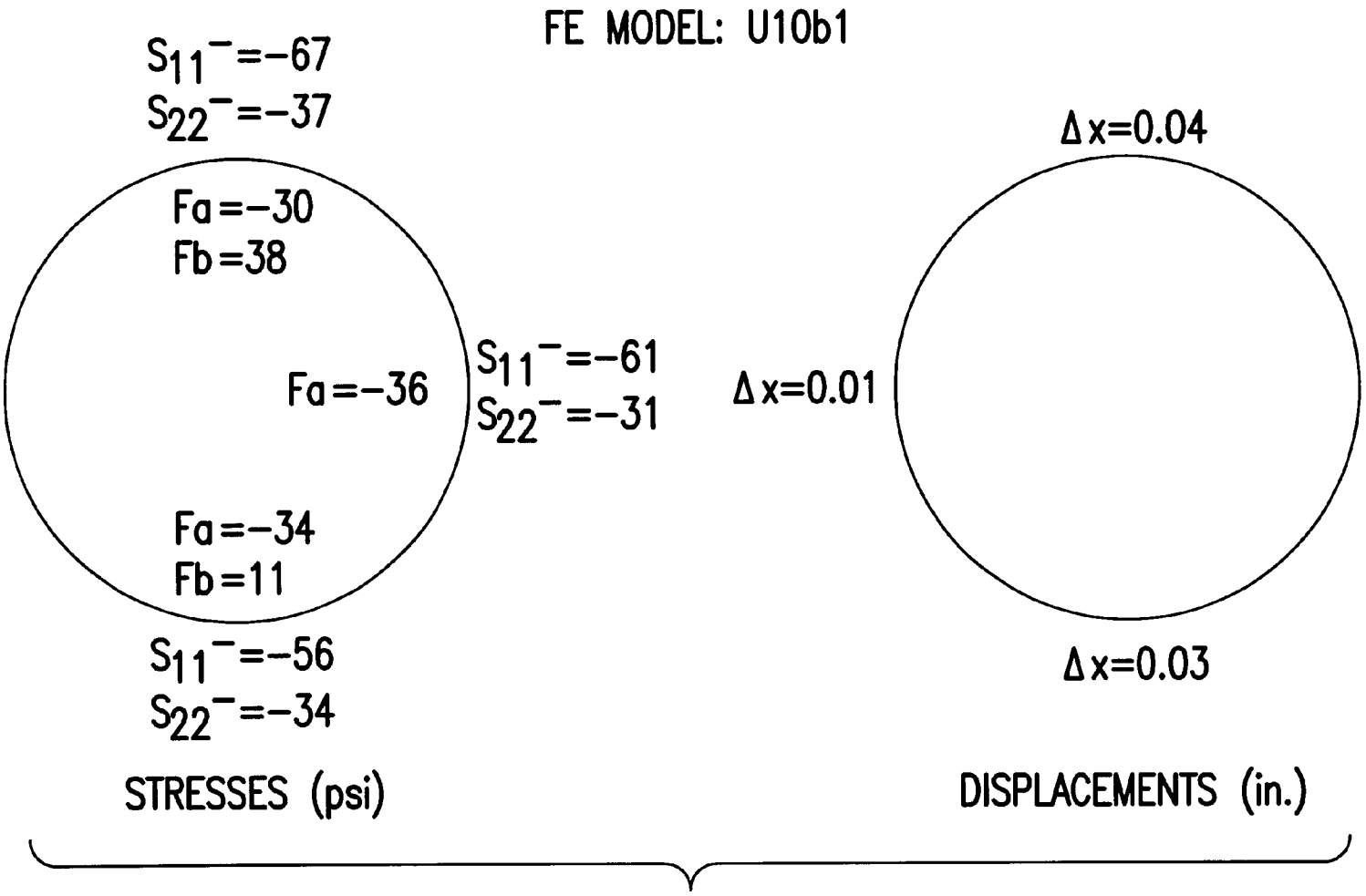
FIGS. 14(A)–14(T) are schematic diagrams showing model results under various conditions according to one embodiment of the present invention.
Figure 14B:
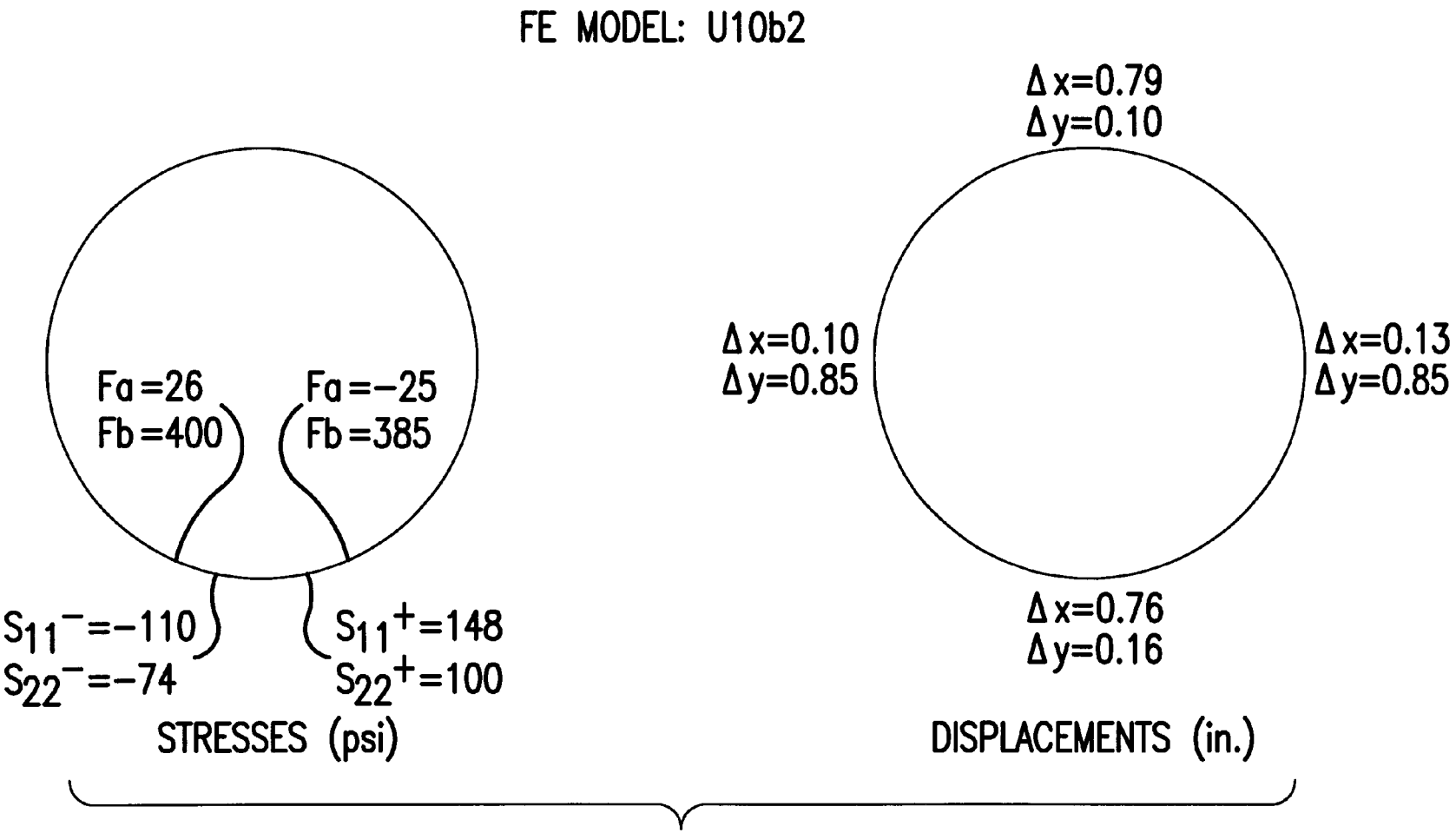
Figure 14C:
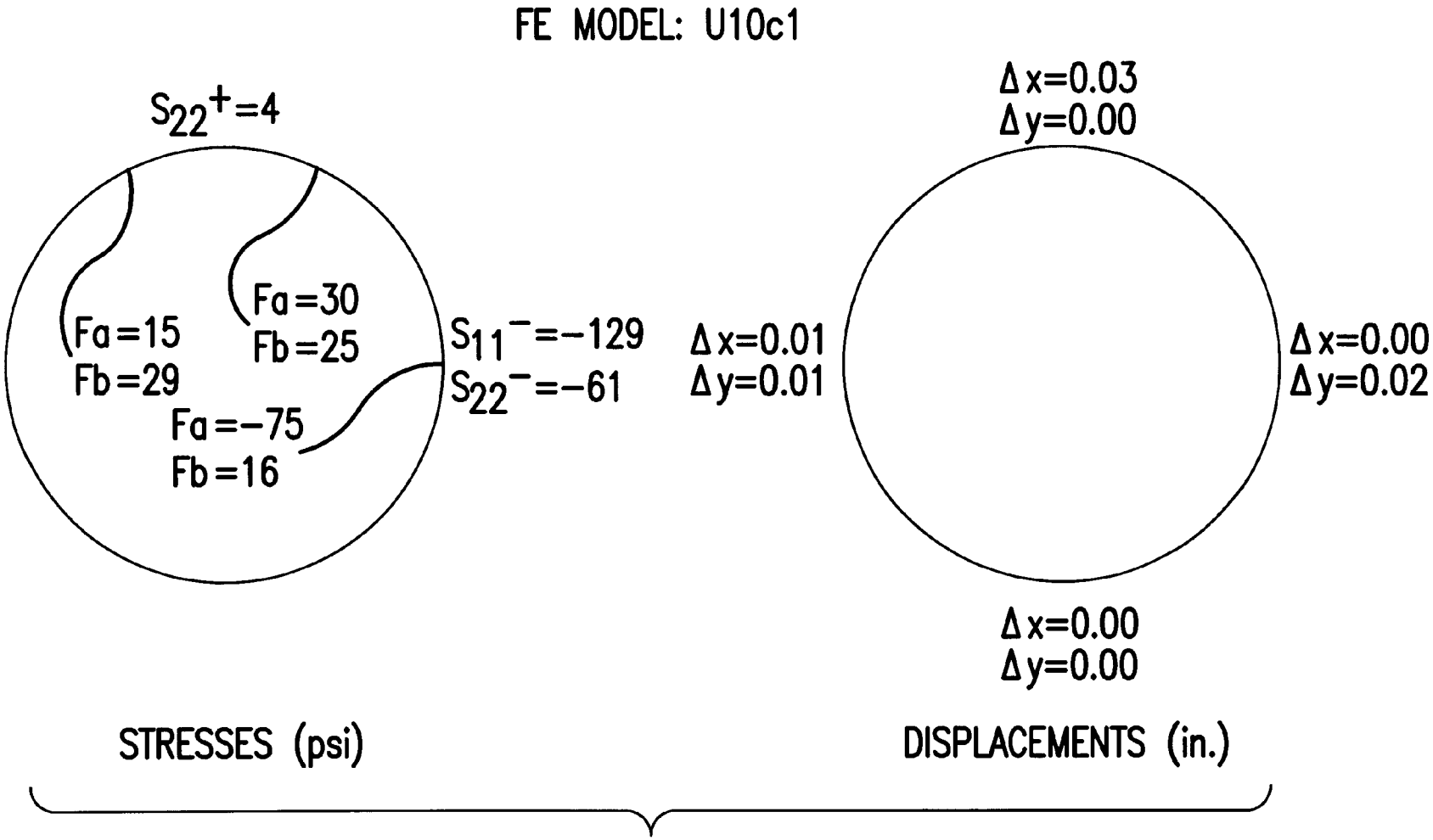
Figure 14D:
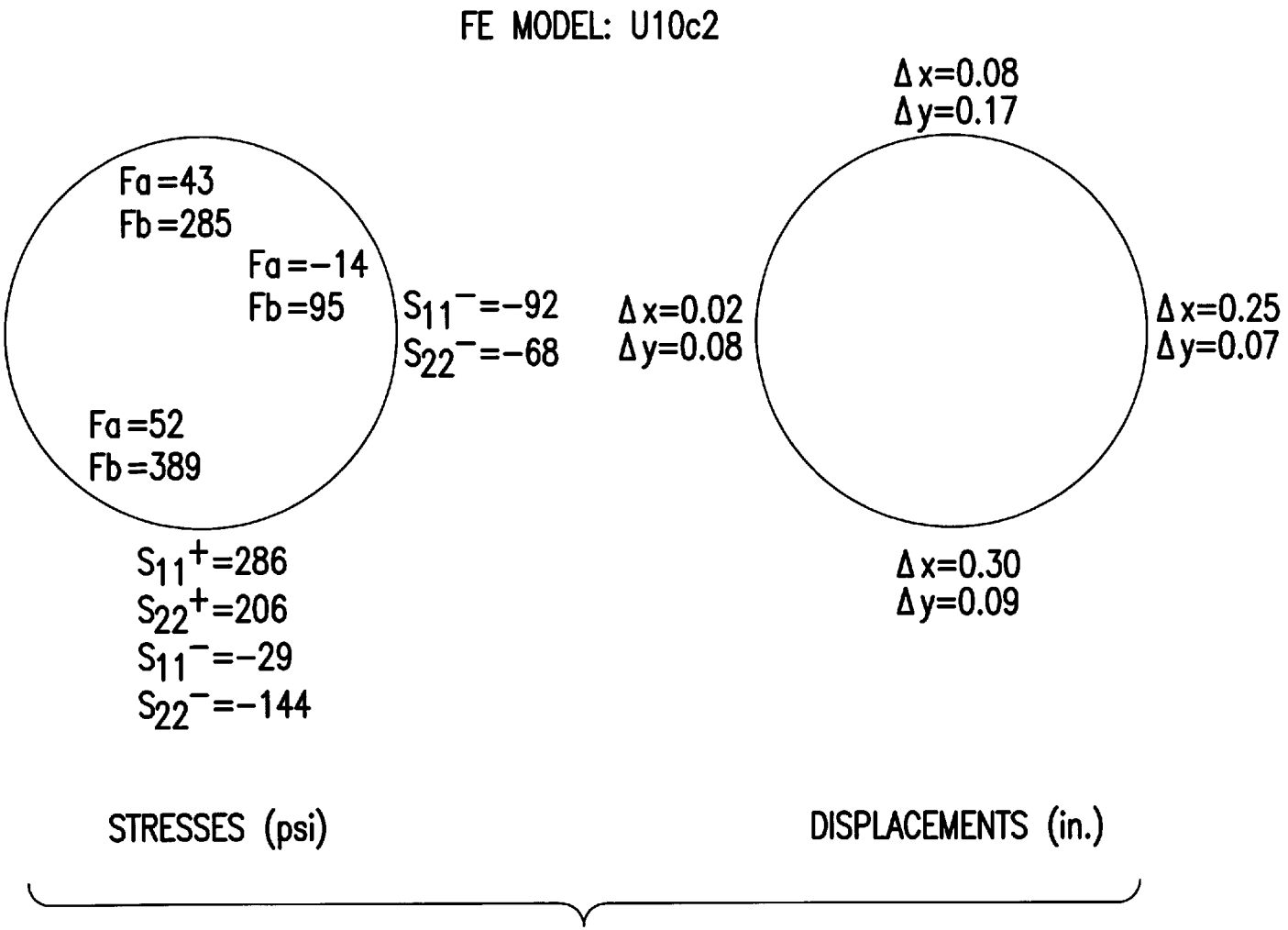
Figure 14E:
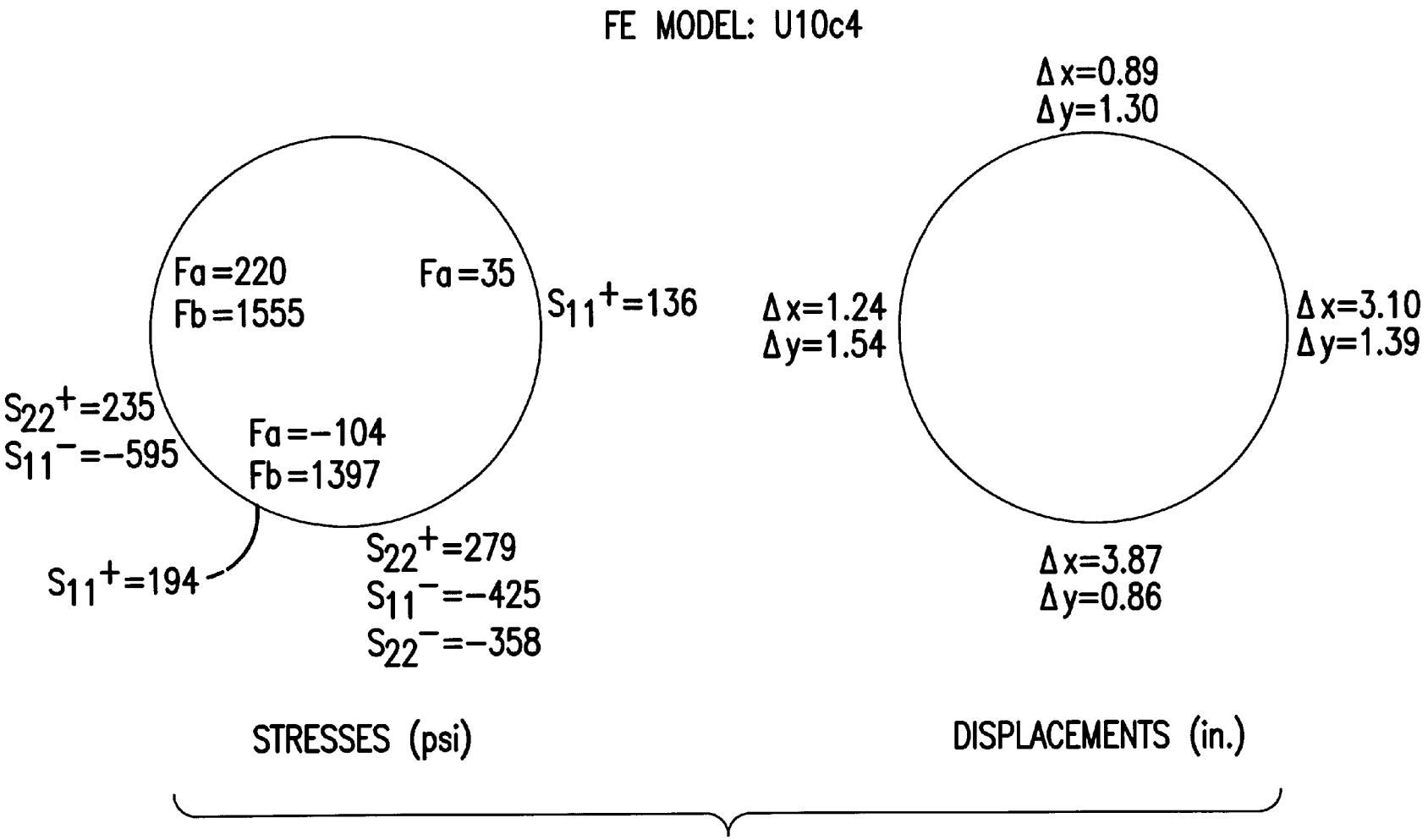
Figure 14F:
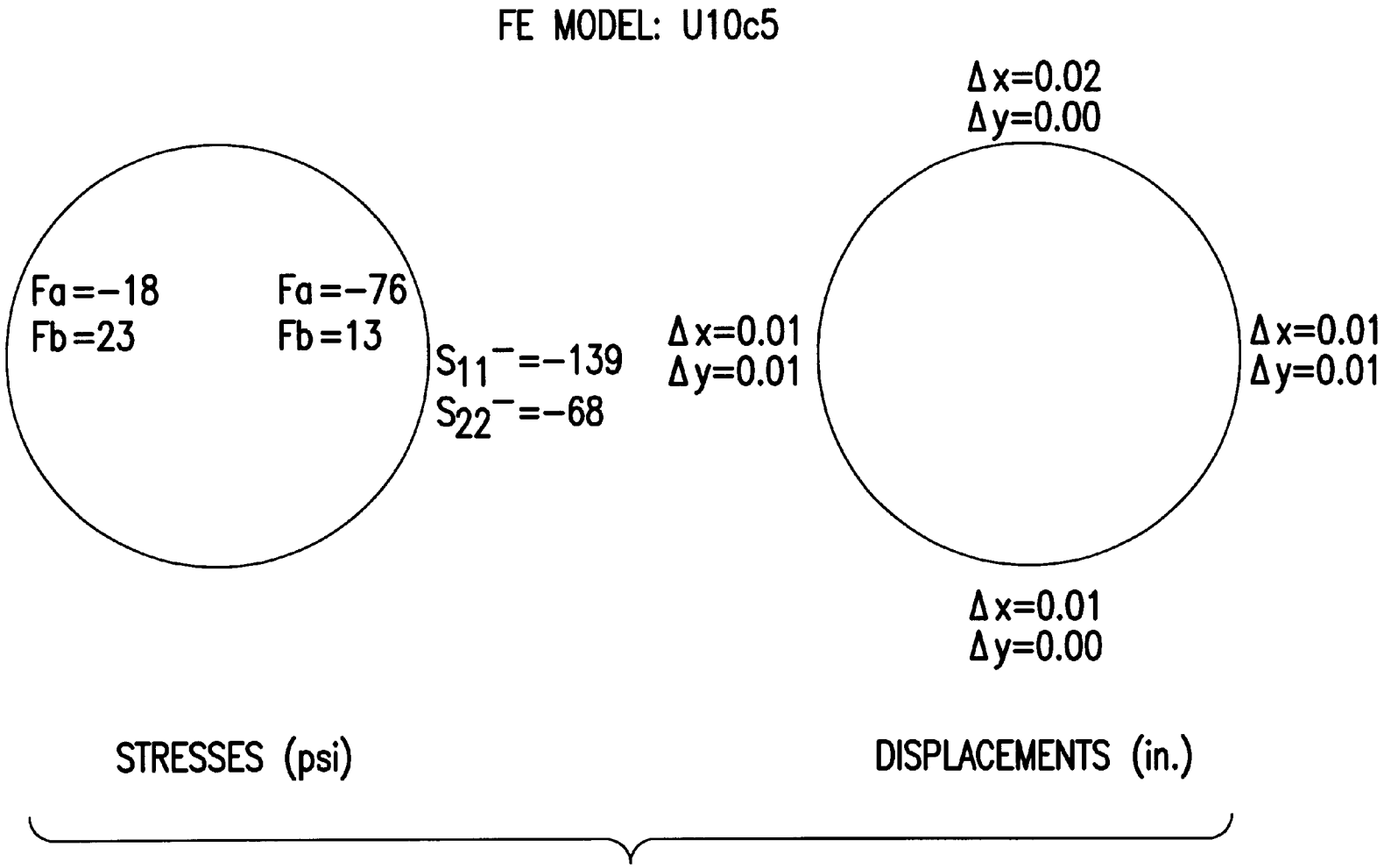
Figure 14G:
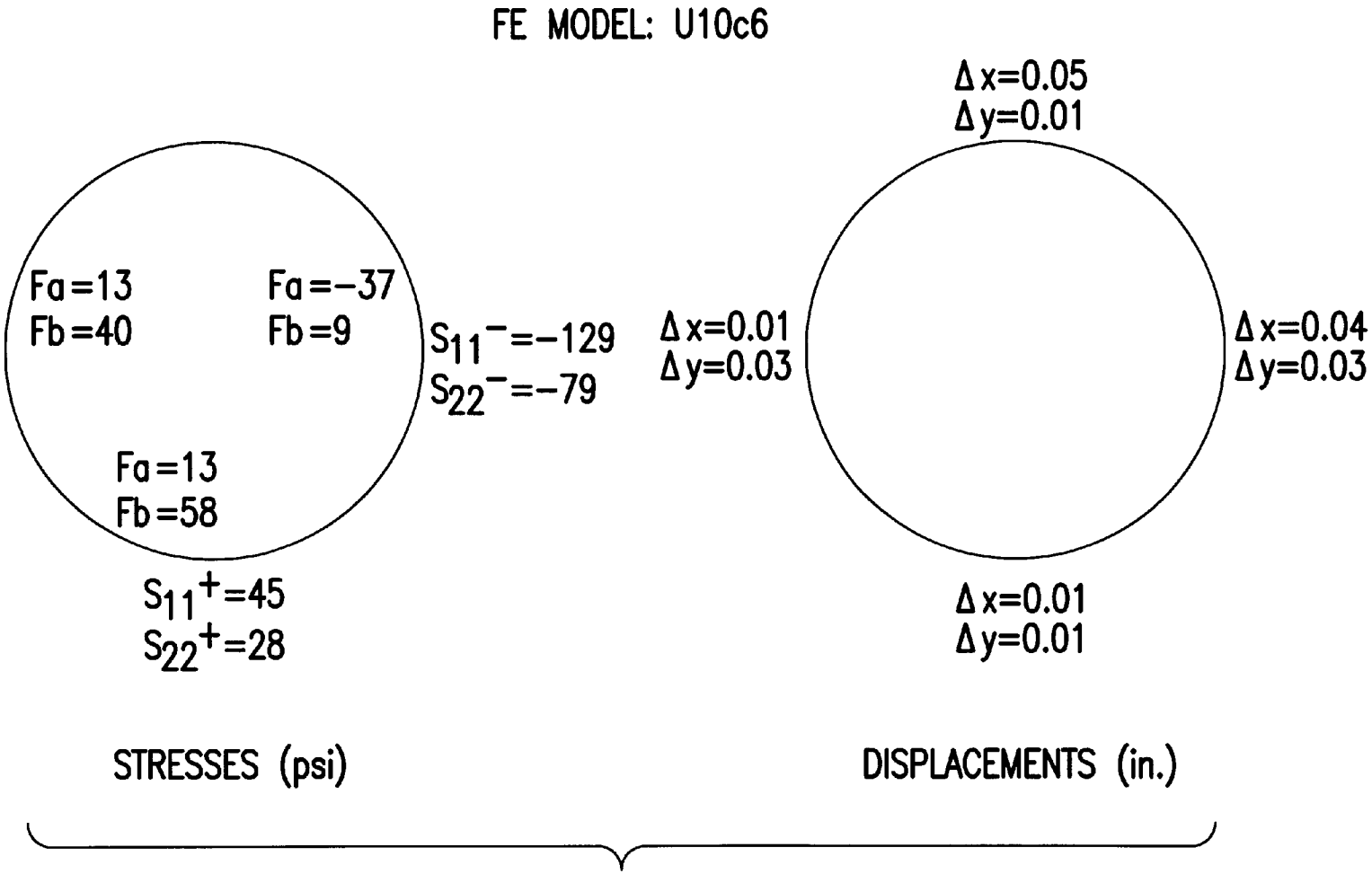
Figure 14H:
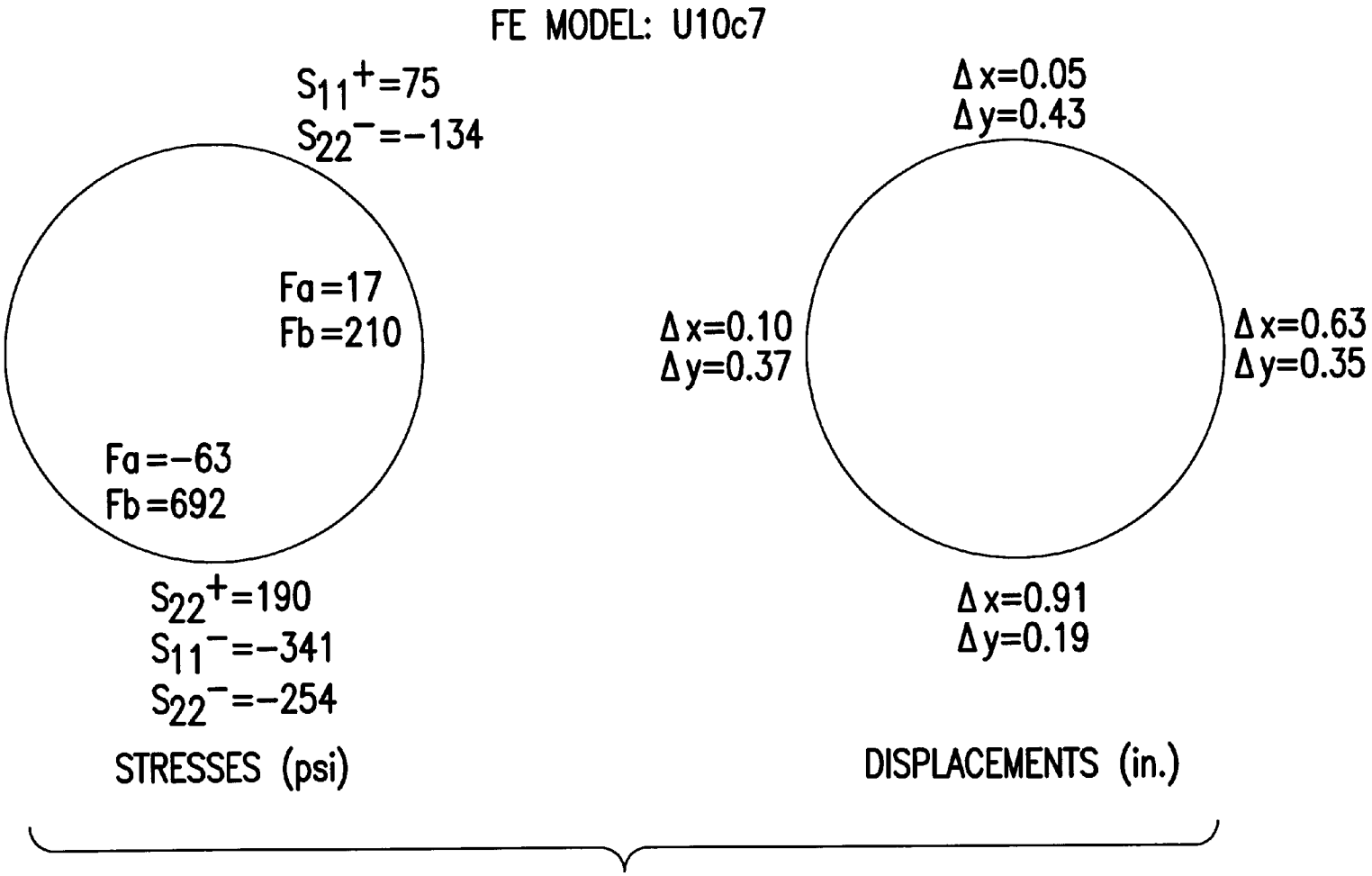
Figure 14I:
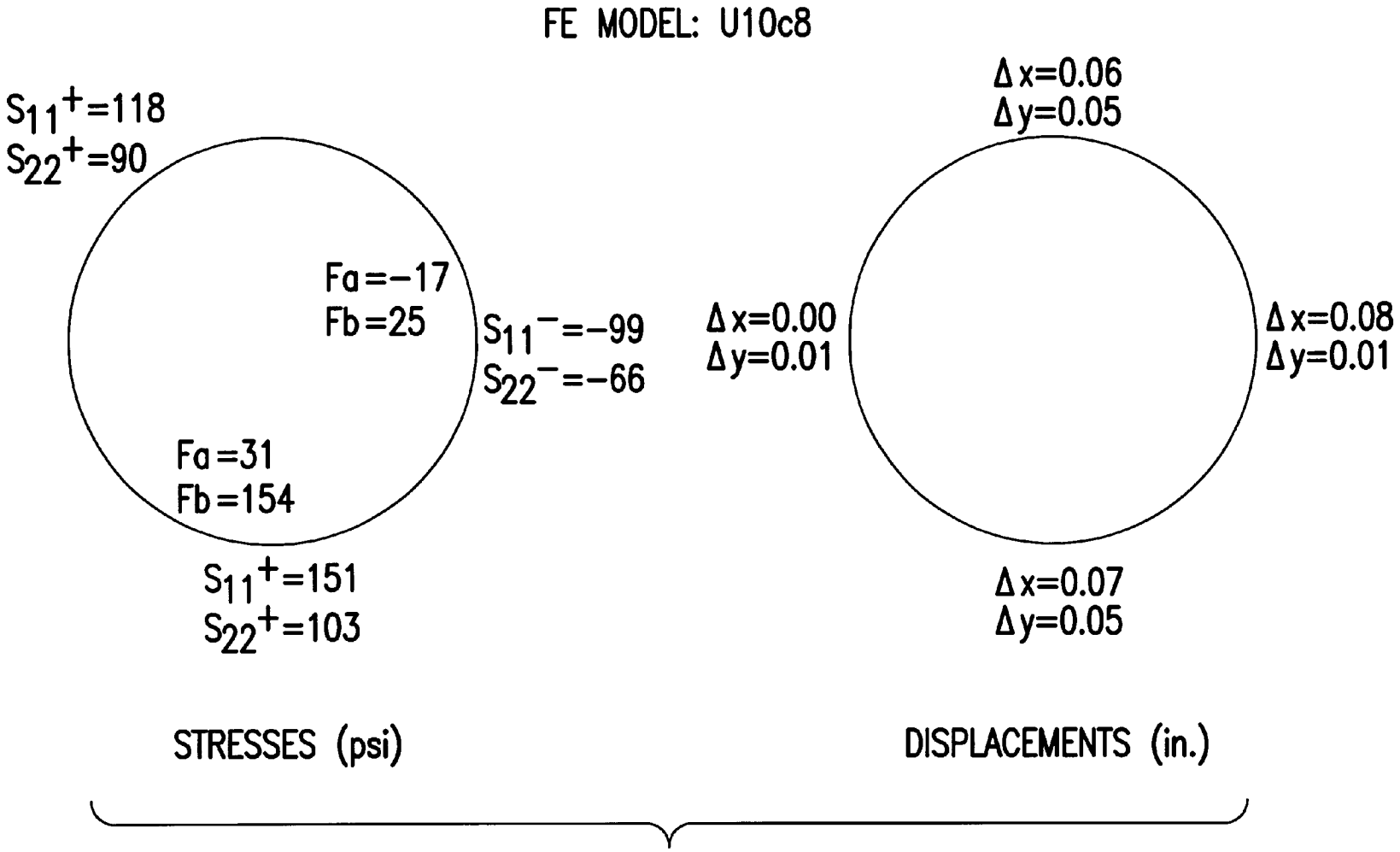
Figure 14J:
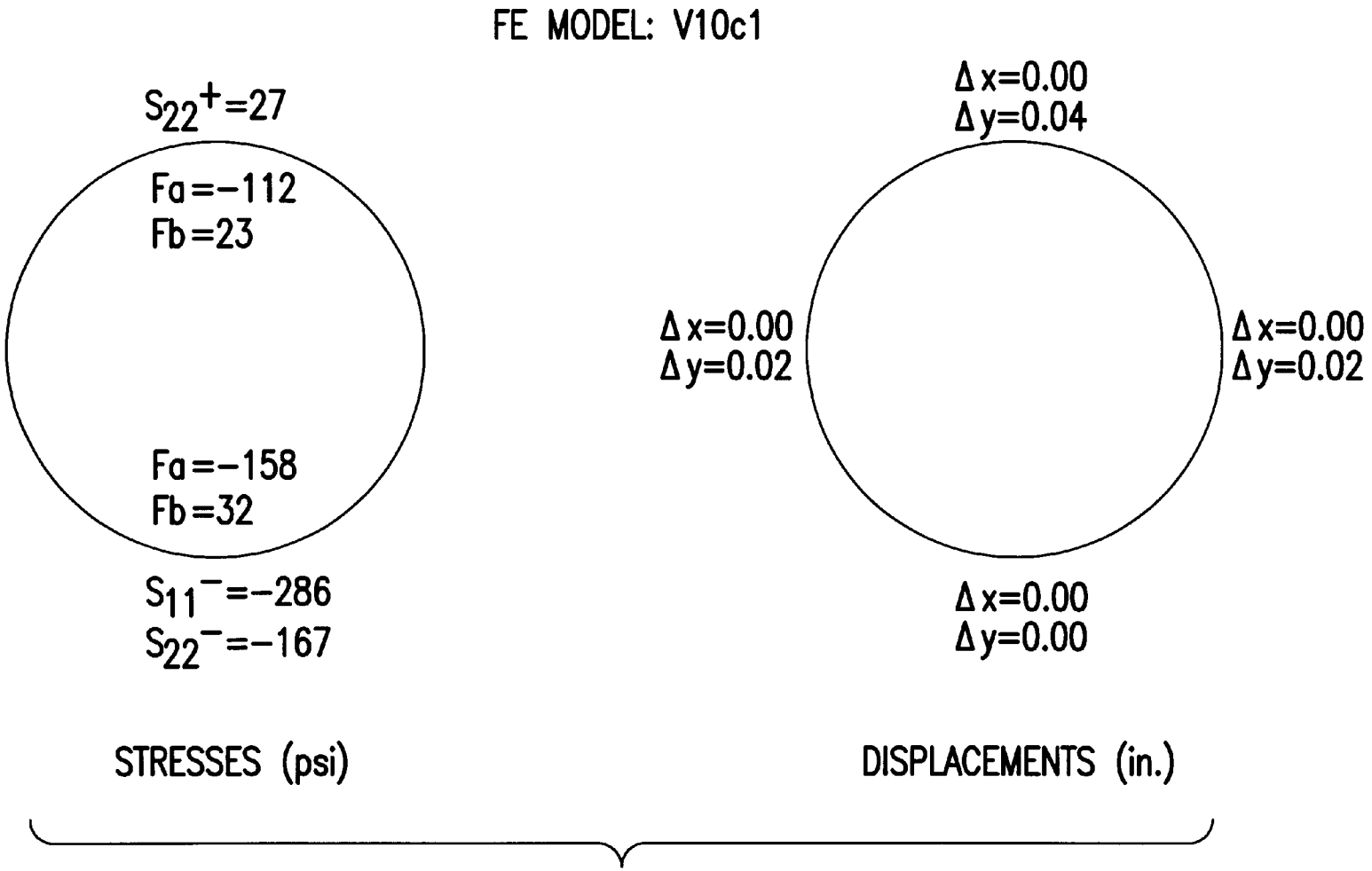
Figure 14K:
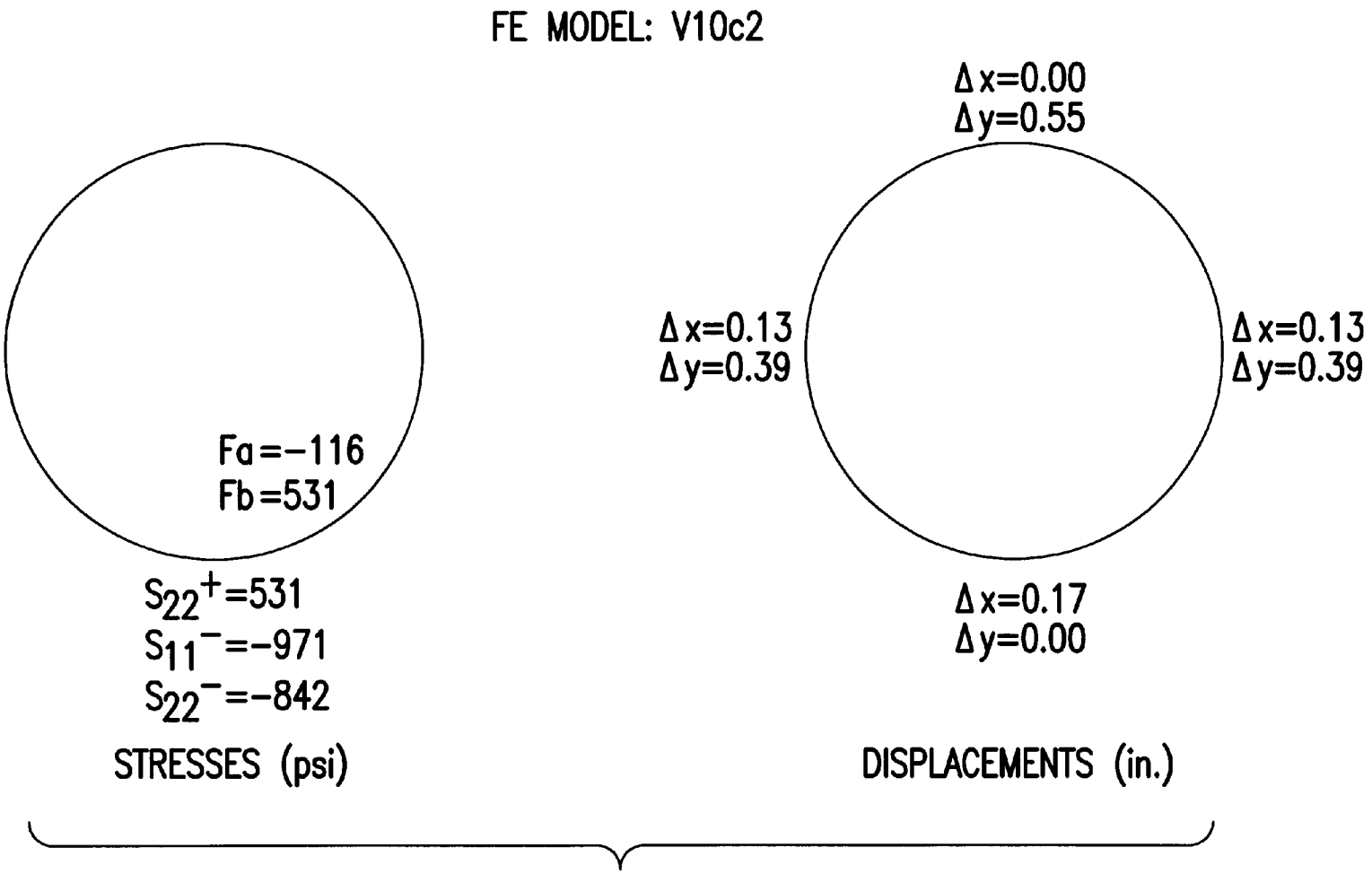
Figure 14L:
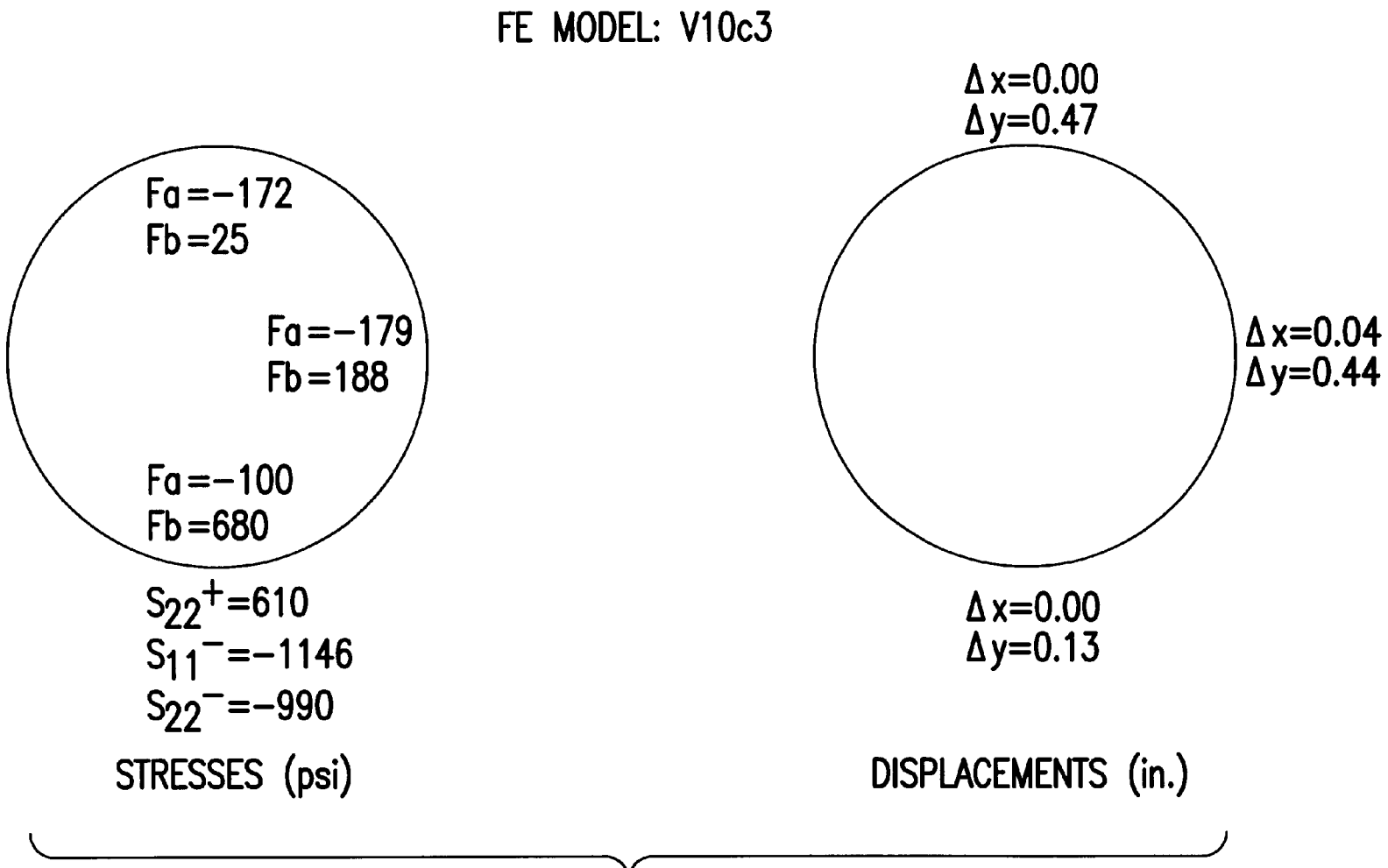
Figure 14M:
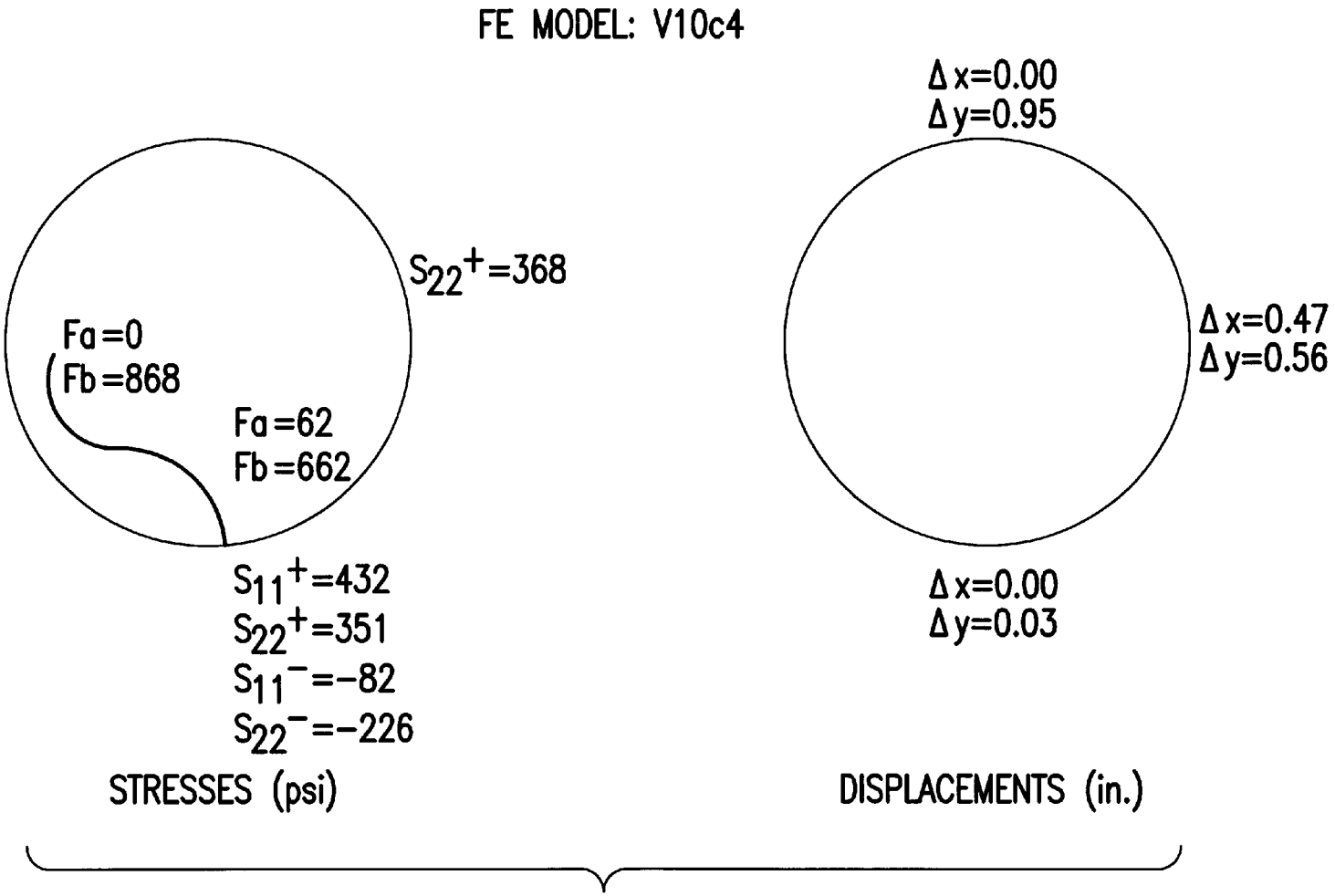
Figure 14N:
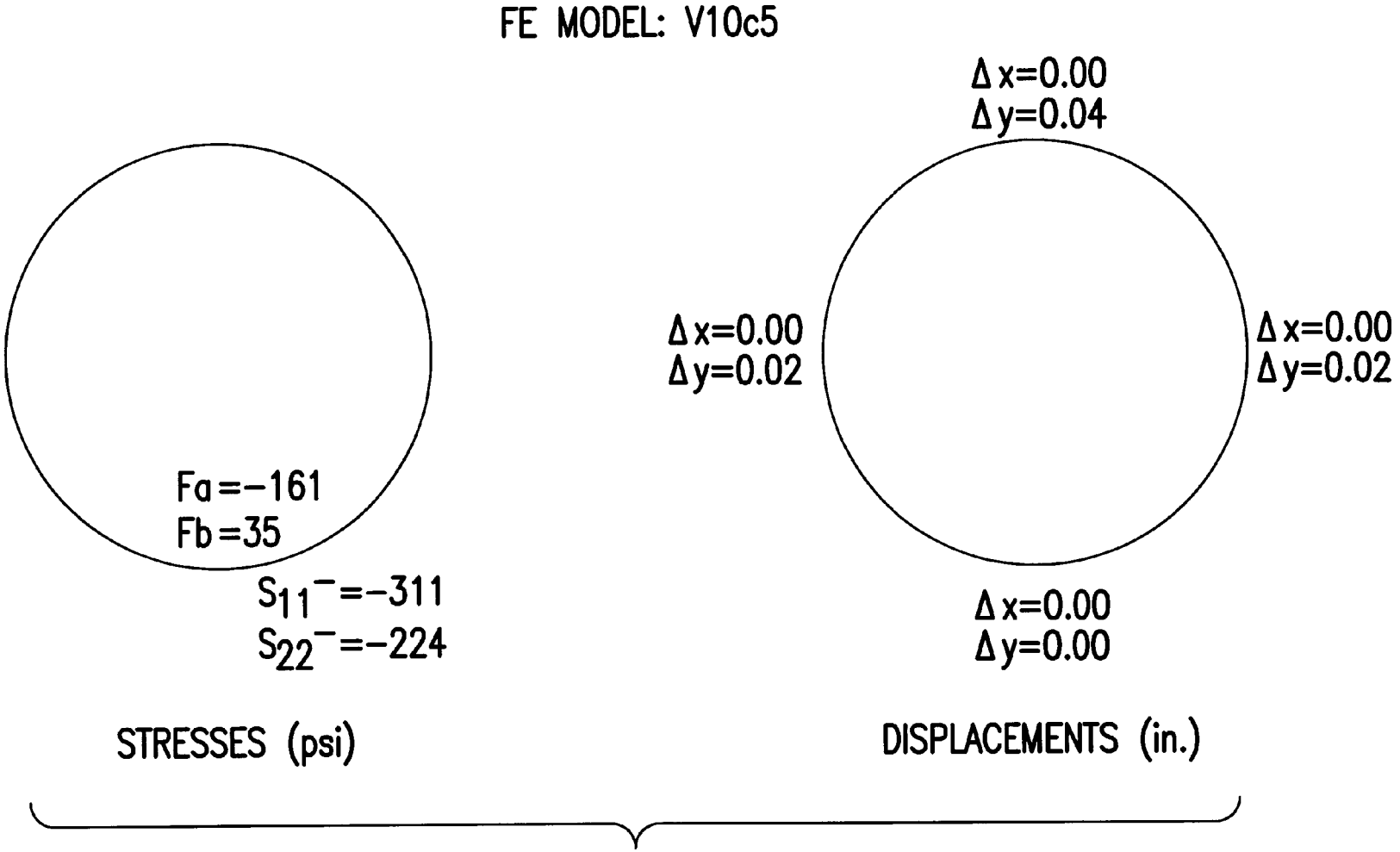
Figure 14O:
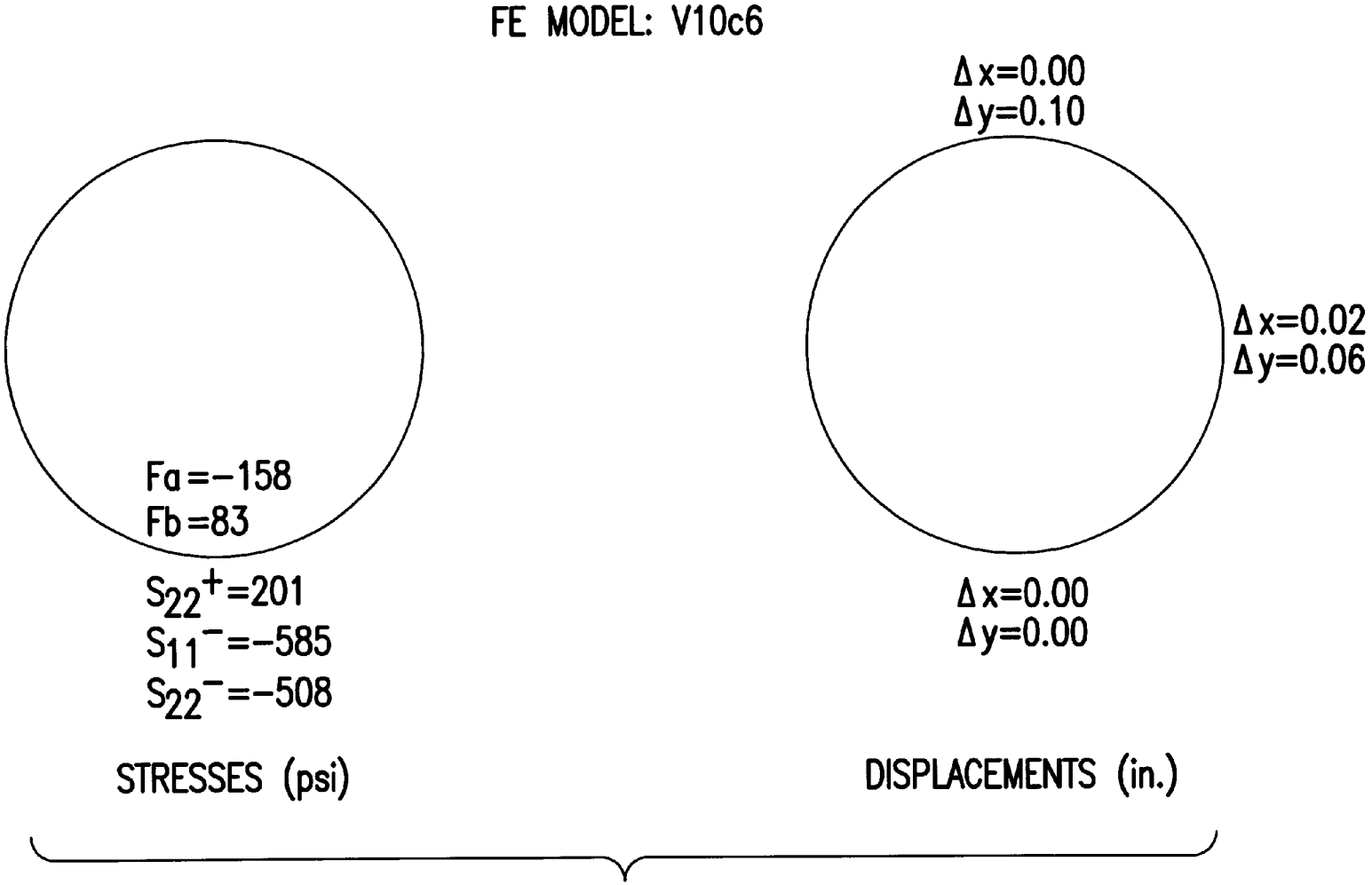
Figure 14P:
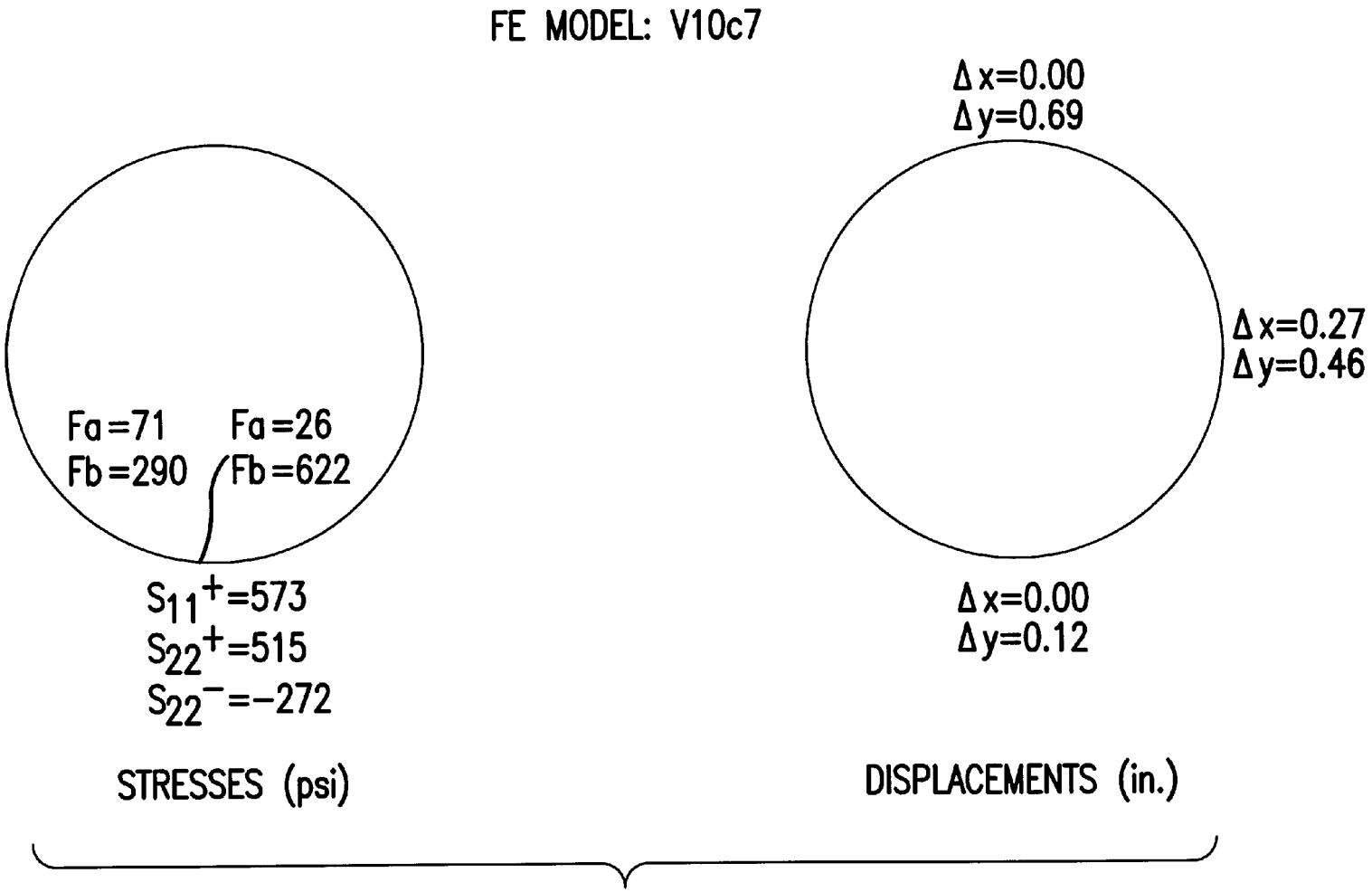
Figure 14Q:
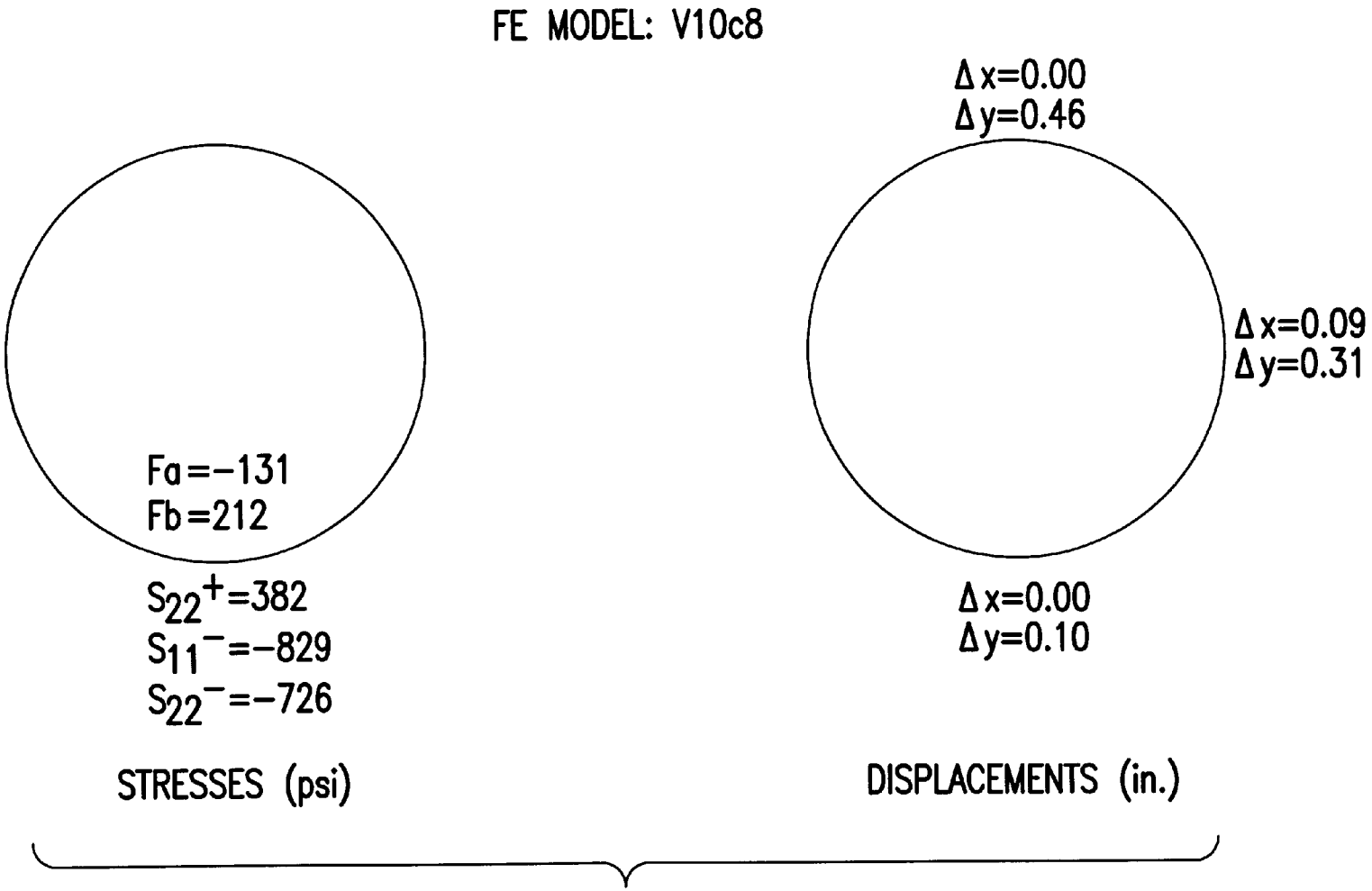
Figure 14R:
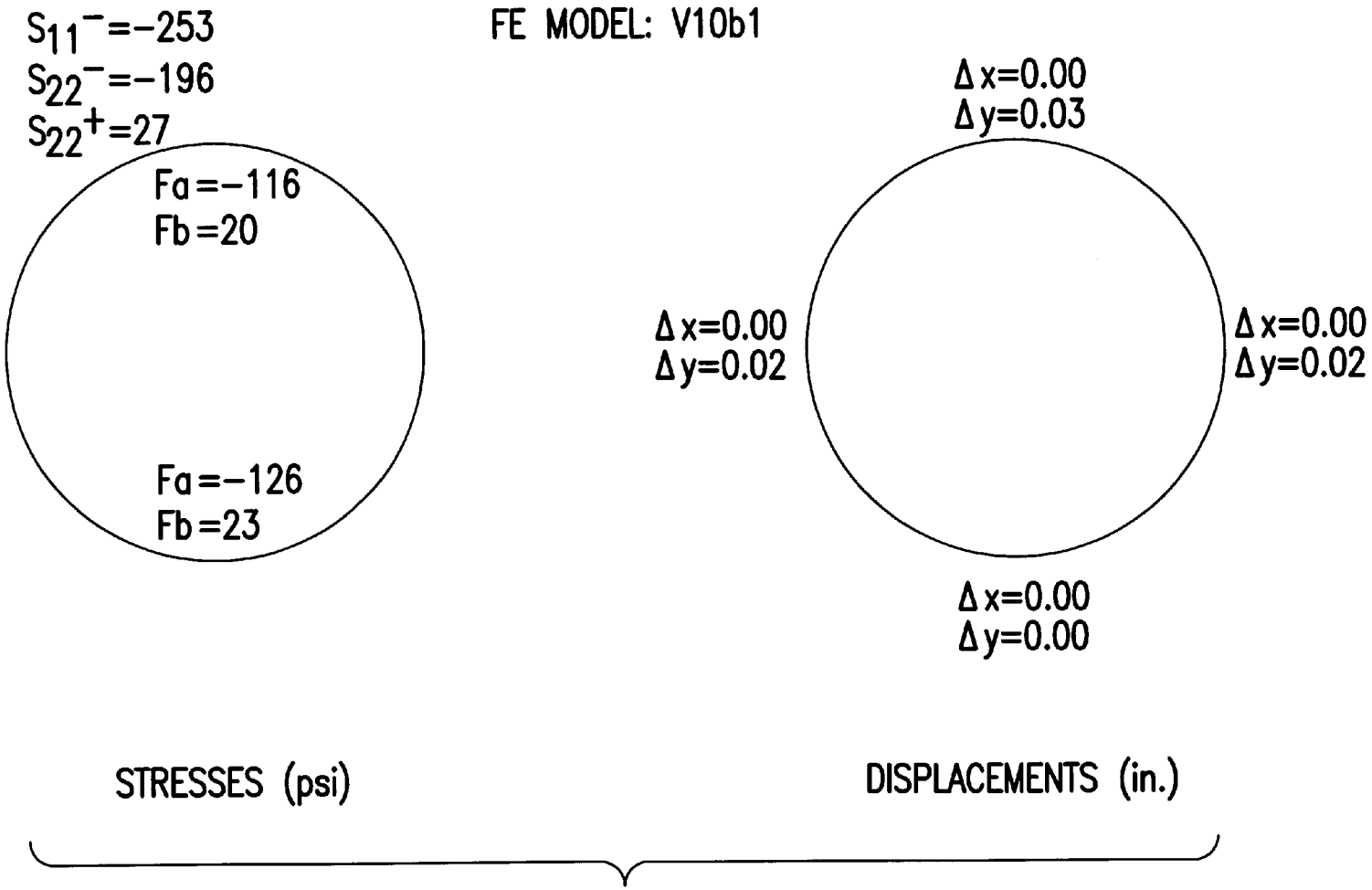
Figure 14S:
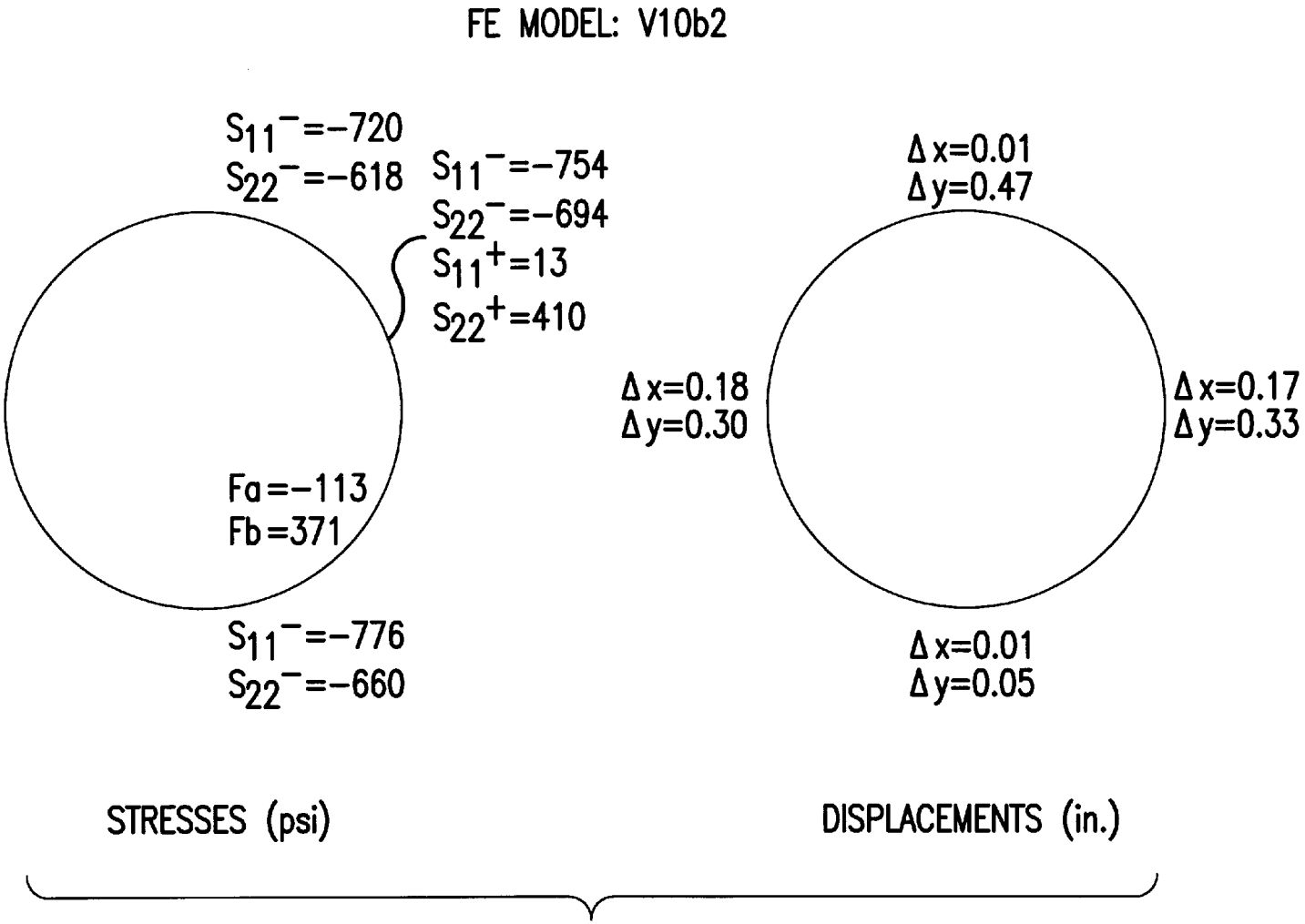
Figure 14T:
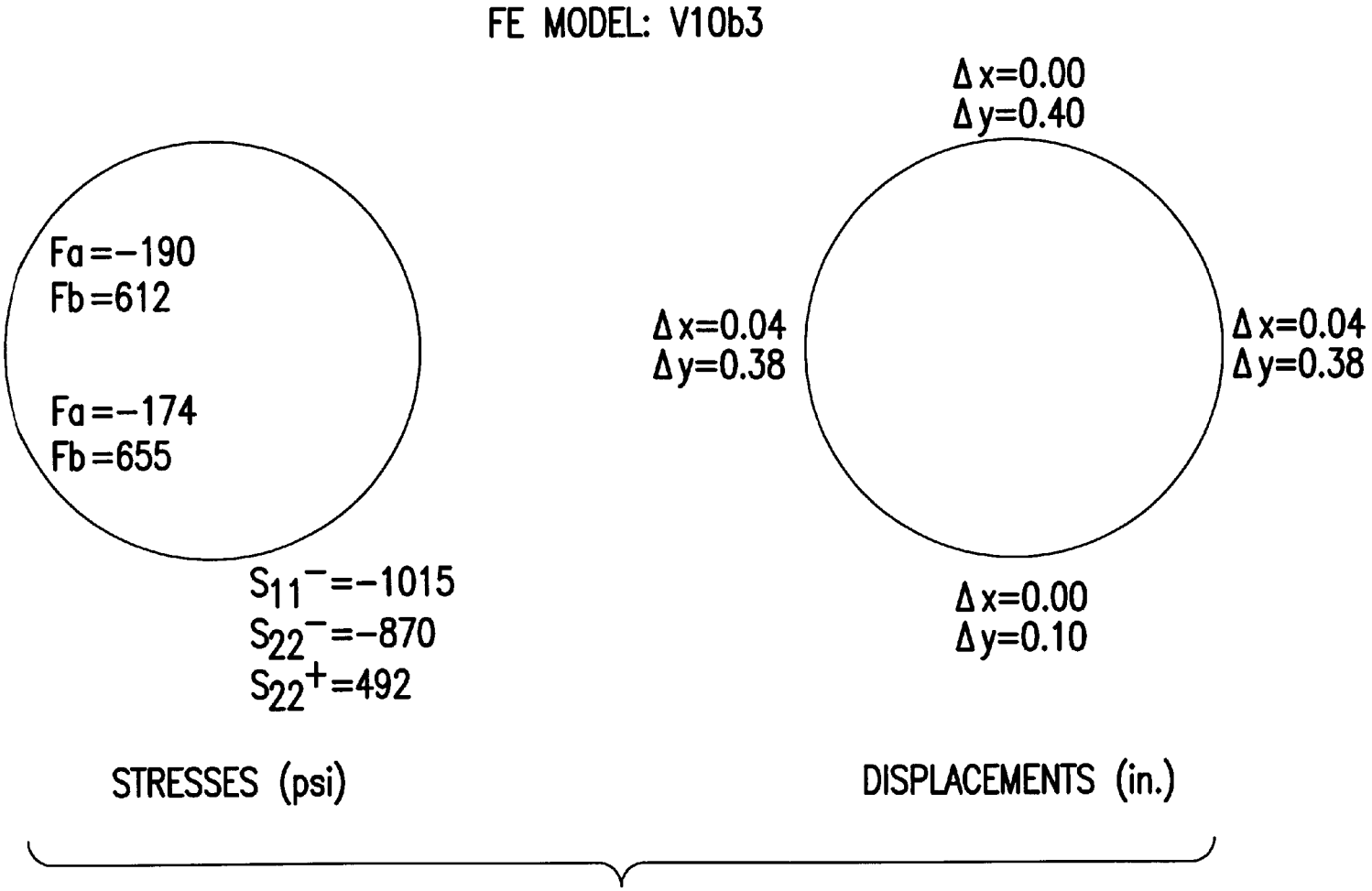

Results obtained with a preferred embodiment of the present invention are shown in FIGS. 14*a*–14*t*. The results are illustrative of only one embodiment of the present invention. A description of the conditions for which the results were obtained follows below.

FIG. 14(A) FE Model U10b1: The FE model U10b1 corresponds to a single underground empty tank (10-ft diameter) subjected to horizontal seismic accelerations. These accelerations were obtained from records of the 1994 Northridge earthquake, and specifically from the Tarzana station. The modulus of elasticity (E) of the backfill gravel in the model varies from 1,008 psi for the elements at the top surface to 6,320 psi at the tank's mid-height. From this level to the bottom of the trench, E is constant with a value of 6,320 psi. The damping coefficient is 0.1.

Maximum values of different types of stresses are obtained when the largest displacement ($\Delta x$) of 0.055 in. is reached in the soil at time t=7.96 s. The highest resultant hoop stresses ($S_{11}$) in the tank shell surface are obtained in the upper part of the tank. In this area, the maximum surface stress ($S_{11}$) which includes both membrane and bending stresses is 67 psi compression. In this same area, the highest resultant axial surface stresses ($S_{22}$) of 37 psi compression is obtained.

The highest values for resultant axial stress (Fa) and bending stress (Fb) in the rib are found at the lower section and upper section of the tank respectively. At time t=7.96 s, the corresponding values for Fa and Fb are 34 psi compression and 38 psi respectively. Lower values for Fa and Fb are found elsewhere.

Resultant deformations in both the shell and the rib are very small. At time t=7.96 s, all translations (Δ) are less than 0.04 in. These deformations are relative to the fixed based at the bottom of the trench where the accelerations were applied.

FIG. 14(B) FE Model U10b2: The FE model U10b2 corresponds to a single underground empty tank (10-ft diameter) subjected to horizontal seismic accelerations. These accelerations were obtained from records of the 1994 Northridge earthquake, and specifically from the Tarzana station. The modulus of elasticity (E) of the gravel in the model is constant with a value of 100 psi. The damping coefficient is 0.1.

Maximum values of different types of stresses are obtained when the largest displacement (Δx) of 0.98 in. is reached in the soil at time t=8.00 s. The highest resultant hoop stresses ($S_{11}$) in the tank shell surface are obtained at the tank bottom. In this area, the maximum surface stresses ($S_{11}$) which includes both membrane and bending stresses are 110 psi compression and 148 psi tension. In this same area, the highest resultant axial surface stresses ($S_{22}$) of 74 psi compression and 100 psi tension are obtained.

The highest value for resultant bending stress (Fb) in the rib is also found at the bottom of the tank. At time t=8.00 s, the value for Fb is 400 psi at that location. The largest axial stress (Fa) in the rib is also obtained near the tank's bottom, and its value is 26 psi.

Resultant deformations are measured with respect to the fixed base where the accelerations were applied. At time t=8.00 s, the largest displacement is the vertical translation (Δy) of the sides of the tank, which deforms 0.85 in. Other horizontal (Δx) translations and vertical translations are shown in FIG. 14(B).

FIG. 14(C) FE Model U10c1: The FE model U10c1 corresponds to a single underground tank (10-ft diameter) full of gasoline and subjected to horizontal seismic accelerations. These accelerations were obtained from records of the 1994 Northridge earthquake, and specifically from the Tarzana station. The modulus of elasticity (E) of the gravel in the model is constant with a value of 6,320 psi from the tank's mid-height to the bottom of the trench, and E varies from 1,008 psi at the top surface to 6,320 psi at the level of the tank's mid-height. The damping coefficient is 0.1.

Maximum values of different types of stresses are obtained when the largest displacement (Δx) of 0.0535 in. is reached in the soil at time t=7.96 s. The highest resultant hoop stress ($S_{11}$) in the tank shell surface is obtained on one side of the tank at mid-height level. In this area, the maximum surface stress ($S_{11}$) which includes both membrane and bending stresses is 129 psi compression. In this same area, the highest resultant axial surface stresses ($S_{22}$) of 61 psi compression is obtained.

The highest value for resultant bending stress (Fb) in the rib is found in the upper section of the tank. At time t=7.96 s, the value for Fb is 29 psi at that location. The largest compressive stress (Fa) is found at the tank's mid-height, and it has a value of 75 psi. Additional values for Fa and Fb are shown in FIG. 14(C).

Resultant deformations are measured with respect to the fixed base where the accelerations were applied. At time t=7.96 s, the largest displacement is the horizontal translation (Δx) of the top of the tank, which deforms 0.03 in. Other vertical translations and horizontal translations (Δx) are show in FIG. 14(C).

FIG. 14(D) FE Model U10c2: The FE model U10c2 corresponds to a single underground tank (10-ft diameter) fill of gasoline and subjected to horizontal seismic accelerations. These accelerations were obtained from records of the 1994 Northridge earthquake, and specifically from the Tarzana station. The modulus of elasticity (E) of the gravel in the model is constant with a value of 100 psi. The damping coefficient is 0.1.

Maximum values of different types of stresses are obtained when the largest displacement (Δx) of 0.828 in. is reached in the soil at time t=8.00 s. The highest resultant hoop stress ($S_{11}$) in the tank shell surface is obtained at the tank bottom. In this area, the maximum surface stress ($S_{11}$) which includes both membrane and bending stresses is 286 psi tension. In this same area, the highest resultant axial surface stresses ($S_{22}$) of 144 psi compression and 206 psi tension are obtained.

The highest value for resultant bending stress (Fb) in the rib is found at the bottom of the tank. At time t=8.00 s, the value for Fb is 389 psi at that location. The largest axial stress (Fa) in the rib is also located at the bottom of the tank and its magnitude is 52 psi. Additional values for Fa and Fb are shown in FIG. 14(D).

Resultant deformations are measured with respect to the fixed base where the accelerations were applied. At time t=8.00 s, the largest displacement is the horizontal translation (Δx) at the bottom of the tank, which deforms 0.30 in. Other vertical translations (Δy) and horizontal translations are shown in FIG. 14(D).

FIG. 14(E) FE Model U10c4: The FE model U10c4 corresponds to a single underground tank (10-ft diameter) full of gasoline and subjected to horizontal seismic accelerations. These accelerations were obtained from records of the 1994 Northridge earthquake, and specifically from the Tarzana station. The modulus of elasticity (E) of the gravel in the model is constant with a value of 10 psi. The damping coefficient is 0.1.

Maximum values of different types of stresses are obtained when the largest displacement (Δx) of 6.71 in. is reached in the soil at time t=8.62 s. the highest resultant hoop stress ($S_{11}$) in the tank shell surface is obtained on one side near the tank's mid-height. In this area, the maximum surface stress ($S_{11}$) which includes both membrane and bending stresses is 595 psi compression. The highest resultant axial surface stresses ($S_{22}$) of 358 psi compression and 279 psi tension are obtained at the bottom of the tank.

The highest value for resultant bending stress (Fb) in the rib is found near the tank's mid-height. At time t=8.62 s, the value for Fb is 1,555 psi in that location. The largest axial stress (Fa) in the rib is also located in the same area and its magnitude is 220 psi tension. Additional values for Fa and Fb are shown in FIG. 14(E).

Resultant deformations of the tank are measured with respect to the fixed base of the trench where the accelerations were applied. At time t=8.62 s, the largest displacement is the horizontal translation (Δx) of the bottom of the tank, which translates 3.87 in. Other horizontal translations and vertical translations (Δy) are shown in FIG. 14(E).

FIG. 14(F) FE Model U10c5: The FE model U10c5 corresponds to a single underground tank (10-ft diameter) full of gasoline and subjected to horizontal seismic accelerations. These accelerations were obtained from records of the 1994 Northridge earthquake, and specifically from the Tarzana station. The modulus of elasticity (E) of the gravel in the model is constant with a value of 5000 psi. The damping coefficient is 0.1.

Maximum values of different types of stresses are obtained when the largest displacement (Δx) of 0.030 in. is reached in the soil at time t=7.96 s. The highest resultant hoop stress ($S_{11}$) in the tank shell surface is obtained on one side near the tank's mid-height.

In this area, the maximum surface stress ($S_{11}$) which includes both membrane and bending stresses is 139 psi compression. In this same area, the highest resultant axial surface stress ($S_2$) of 68 psi compression is obtained.

The highest value for resultant bending stress (Fb) in the rib is also found near the tank's mid-height. At time t=7.96 s, the value for Fb is 23 psi at that location. The largest axial stress in the rib is also near the mid-height of the tank and its magnitude is 76 psi compression.

Resultant deformations of the tank are measured with respect to the fixed base of the trench where the accelerations were applied. At time t=7.96 s, the largest displacement is the horizontal translation (Δx) of the top of the tank, which translates 0.02 in. Other horizontal translations and vertical translations (Δx) of the top of the tank, which translates 0.02 in. Other horizontal translations and vertical translations (Δy) are shown in FIG. 14(F).

FIG. 14(G) FE Model U10c6: The FE model U10c6 corresponds to a single underground tank (10-ft diameter) full of gasoline and subjected to horizontal seismic accelerations. These accelerations were obtained from records of the 1994 Northridge earthquake, and specifically from the Tarzana station. The modulus of elasticity (E) of the gravel in the model is constant with a value of 1000 psi. The damping coefficient is 0.1.

Maximum values of different types of stresses are obtained when the largest displacement (Δx) of 0.104 in. is reached in the soil at time t=7.96 s. The highest resultant hoop stress ($S_{11}$) in the tank shell surface is obtained on one side near the tank's mid-height. In this area, the maximum surface stress ($S_{11}$) which includes both membrane and bending stresses is 129 psi compression. In this same area, the highest resultant axial surface stress ($S_{22}$) of 79 psi compression is obtained.

The highest value for resultant bending stress (Fb) in the rib is found near the bottom of the tank. At time t=7.96 s, the value for Fb is 58 psi at that location. The largest axial stress in the rib is near the mid-height of the tank and its magnitude is 37 psi compression.

Resultant deformations of the tank are measured with respect to the fixed base of the trench where the accelerations were applied. At time t=7.96 s, the largest displacement is the horizontal translation (Δx) of the top of the tank, which translates 0.05 in. Other horizontal translations and vertical translations (Δy) are shown in FIG. 14(G).

FIG. 14(H) FE Model U10c7: The FE model U10c7 corresponds to a single underground tank (10-ft diameter) full of gasoline and subjected to horizontal seismic accelerations. These accelerations were obtained from records of the 1994 Northridge earthquake, and specifically from the Tarzana station. The modulus of elasticity (E) of the gravel in the model is constant with a value of 30 psi. The damping coefficient is 0.1.

Maximum values of different types of stresses are obtained when the largest displacement (Δx) of 2.47 in. is reached in the soil at time t=8.58 s. The highest resultant hoop stress ($S_{11}$) in the tank shell surface is obtained at the bottom of the tank. In this area, the maximum surface stress ($S_{11}$), which includes both membrane and bending stresses, is 341 psi compression. In this same area, the highest resultant axial surface stresses ($S_{22}$) of 254 psi compression and 190 psi tension are obtained.

The highest value for resultant bending stress (Fb) in the rib is also found at the bottom of the tank. At time t=8.58 s, the value for Fb is 692 psi at that location. The largest axial stress in the rib is near the bottom of the tank, and its magnitude is 63 psi.

Resultant deformations of the tank are measured with respect to the fixed base of the trench where the accelerations were applied. At time t=8.58 s, the largest displacement is the horizontal translation (Δx) of the bottom of the tank, which translates 0.91 in. Other horizontal translations and vertical translations (Δy) are shown in FIG. 14(H).

FIG. 14(I) FE Model U10c8: The FE model U10c8 corresponds to a single underground tank (10-ft diameter) full of gasoline and subjected to horizontal seismic accelerations. These accelerations were obtained from records of the 1994 Northridge earthquake, and specifically from the Tarzana station. The modulus of elasticity (E) of the gravel in the model is constant with a value of 300 psi. The damping coefficient is 0.1.

Maximum values of different types of stresses are obtained when the largest displacement (Δx) of 2.95 in. is reached in the soil at time t=7.98 s. The highest resultant hoop stress ($S_{11}$) in the tank shell surface is obtained at the bottom of the tank. In this area, the maximum surface stress ($S_{11}$), which includes both membrane and bending stresses, is 151 psi tension. In this same area, the highest resultant axial surface stresses ($S_{22}$) of 103 psi tension is obtained.

The highest value for resultant bending stress (Fb) in the rib is found near the bottom of the tank. At time t=7.98 s, the value for Fb is 154 psi in that location. The largest axial stress in the rib is also near the bottom of the tank and its magnitude is 31 psi tension.

Resultant deformations of the tank are measured with respect to the fixed base of the trench where the accelerations were applied. At time t=7.98 s, the largest displacement is the horizontal translation (Δx) of one side of the tank, which translates 0.08 in. Other horizontal translations and vertical translations (Δy) are shown in FIG. 14(I).

FIG. 14(J) FE Model V10c1: The FE model V10c1 corresponds to a single underground tank (10-ft diameter) full of gasoline and subjected to horizontal seismic accelerations. These accelerations were obtained from records of the 1994 Northridge earthquake, and specifically from the Tarzana station. The modulus of elasticity (E) of the gravel in the model varies from 1,008 psi at the top surface to 6,320 psi at the tank's mid-height. From this level to the bottom of the trench, E is constant with a value of 6,320 psi. The damping coefficient is 0.1.

Maximum values of different types of stresses are obtained when the largest displacement (Δy) of 0.046 in. is reached in the soil at time t=8.52 s. The highest resultant hoop stress ($S_{11}$) in the tank shell surface are obtained at the bottom of the tank. In this area, maximum surface stress ($S_{11}$), which includes both membrane and bending stresses is 286 psi compression. In the same area, the highest resultant axial surface stress ($S_{22}$) of 167 psi compression is obtained. The largest tensile ($S_{22}$) stress occurs at the top of the tank and it has a magnitude of 27 psi.

The highest value for resultant axial stress (Fa) and bending stress (Fb) in the rib are also found at the bottom of the tank. At time t=8.52 s, the corresponding values for Fa and Fb are 158 psi (compression) and 32 psi respectively. Lower values for Fa and Fb are found at the top of the tank, where Fa and Fb are 112 psi (compression) and 23 psi respectively.

Resultant deformations in both the shell and the rib are very small. At time t=8.52 s, all translations (Δ) are less than 0.05 in. These deformations are relative to the fixed based at the bottom of the trench where the accelerations were applied.

FIG. 14(K) FE Model V10c2: The FE model V10c2 corresponds to a single underground tank (10-ft diameter) fill of gasoline and subjected to vertical seismic accelerations. These accelerations were obtained from records of the 1994 Northridge earthquake, and specifically from the Tarzana station. The modulus of elasticity (E) of the gravel in the model is constant with a value of 100 psi. The damping coefficient is 0.1.

Maximum values of different types of stresses are obtained when the largest displacement (Δy) of 0.804 in. is reached in the soil at time t=8.54 s. The highest resultant hoop stress ($S_{11}$) in the tank shell surface are obtained at the tank bottom. In this area, maximum surface stress ($S_{11}$), which includes both membrane and bending stresses, is 971 psi compression. In the same area, the highest resultant axial surface stresses ($S_{22}$) of 842 psi compression and 531 psi tension are obtained.

The highest value for resultant axial stress (Fb) in the rib is also found at the bottom of the tank. At time t=8.54 s, the value for Fb is 531 psi at that location. The largest compressive stress (Fa) is found near the tank's mid-height, and it has a value of 116 psi.

Resultant deformations are measured with respect to the fixed base where the accelerations were applied. At time t=8.54 s, the largest displacement is the vertical translation (Δy) of the top of the tank, which deforms 0.55 in. Other vertical translations and horizontal translations (Δx) are shown in FIG. 14(K).

FIG. 14(L) FE Model V10c3: The FE model V10c3 corresponds to a single underground tank (10-ft diameter) full of gasoline and subjected to vertical seismic accelerations. These accelerations were obtained from records of the 1994 Northridge earthquake, and specifically from the Tarzana station. The modulus of elasticity (E) of the gravel in the model is constant with a value of 100 psi from the tank's mid-height to the bottom of the trench, and E varies from 1,008 psi at the tip surface to 6,238 psi at the level of the tank's mid-height. The damping coefficient is 0.1.

Maximum values of different types of stresses are obtained when the largest displacement (Δy) of 0.504 in. is reached in the soil at time t=8.52 s. The highest resultant hoop stress ($S_{11}$) in the tank shell surface are obtained at the tank bottom. In this area, maximum surface stress ($S_{11}$), which includes both membrane and bending stresses, is 1,146 psi compression. In the same area, the highest resultant axial surface stresses ($S_{22}$) of 990 psi compression and 610 psi tension are obtained.

The highest value for resultant bending stress (Fb) in the rib is also found at the bottom of the tank. At time t=8.52 s, the value for Fb is 680 psi in that location. The largest compressive stress (Fa) is found near the tank's mid-height, and it has a value of 179 psi. Additional values for Fa and Fb are shown in FIG. 14(L).

Resultant deformations are measured with respect to the fixed base where the accelerations were applied. At time t=8.52 s, the largest displacement is the vertical translation (Δy) of the top of the tank, which deforms 0.47 in. Other vertical translations (Δy) and horizontal translations (Δx) are shown in FIG. 14(L).

FIG. 14(M) FE Model V10c4: The FE model V10c4 corresponds to a single underground tank (10-ft diameter) full of gasoline and subjected to vertical seismic accelerations. These accelerations were obtained from records of the 1994 Northridge earthquake, and specifically from the Tarzana station. The modulus of elasticity (E) of the gravel in the model is constant with a value of 10 psi. The damping coefficient is 0. 1.

Maximum values of different types of stresses are obtained when the largest displacement (Δy) of 2.90 in. is reached in the soil at time t=8.58 s. The highest resultant hoop stress ($S_{11}$) in the tank shell surface are obtained at the tank bottom. In this area, the maximum surface stresses ($S_{11}$), which includes both membrane and bending stresses, are 82 psi compression and 432 psi tension. In the same area, resultant axial surface stresses ($S_{22}$) of 226 psi compression and 351 psi tension are obtained. The largest $S_{22}$ stress is found near the tank's mid-height and it has a value of 368 psi.

The highest value for resultant bending stress (Fb) in the rib is found at the bottom of the tank. At time t=8.58 s, the value for Fb is 868 psi in that location. The largest axial compressive stress (Fa) is found in the same area, and it has a value of 62 psi.

Resultant deformations are measured with respect to the fixed base where the accelerations were applied. At time t=8.58 s, the largest displacement is the vertical translation (Δy) of the top of the tank, which deforms 0.95 in. Other vertical translations and horizontal translations (Δx) are shown in FIG. 14(M).

FIG. 14(N) FE Model V10c5: The FE model V10c5 corresponds to a single underground tank (10-ft diameter) full of gasoline and subjected to vertical seismic accelerations. These accelerations were obtained from records of the 1994 Northridge earthquake, and specifically from the Tarzana station. The modulus of elasticity (E) of the gravel in the model is constant with a value of 5,000 psi. The damping coefficient is 0.1.

Maximum values of different types of stresses are obtained when the largest displacement (Δy) of 0.046 in. is reached in the soil at time t=8.52 s. The highest resultant hoop stress ($S_{11}$) in the tank shell surface are obtained at the tank bottom. In this area, the maximum surface stress ($S_{11}$), which includes both membrane and bending stresses, is 311 psi compression. In this same area, the highest resultant axial surface stress ($S_{22}$) of 224 psi compression is obtained.

The highest value for resultant bending stress (Fb) in the rib is also found at the bottom of the tank. At time t=8.52 s, the value for Fb is 35 psi in that location. The largest compressive stress (Fa) is also found in that area, and it has a value of 161 psi.

Resultant deformations are measured with respect to the fixed base where the accelerations were applied. At time t=8.52 s, the largest displacement is the vertical translation (Δy) of the top of the tank, which deforms 0.04 in. Other vertical translations and horizontal translations (Δx) are shown in FIG. 14(N).

FIG. 14(O) FE Model V10c6: The FE model V10c6 corresponds to a single underground tank (10-ft diameter) full of gasoline and subjected to vertical seismic accelerations. These accelerations were obtained from records of the 1994 Northridge earthquake, and specifically from the Tarzana station. The modulus of elasticity (E) of the gravel in the model is constant with a value of 1,000 psi. The damping coefficient is 0.1.

Maximum values of different types of stresses are obtained when the largest displacement (Δy) of 0.127 in. is reached in the soil at time t=8.52 s. The highest resultant hoop stress ($S_{11}$) in the tank shell surface are obtained at the tank bottom. In this area, the maximum surface stress ($S_{11}$), which includes both membrane and bending stresses, is 585 psi compression. In this same area, the highest resultant axial surface stresses ($S_{22}$) of 508 psi compression and 201 psi tension are obtained.

The highest value for resultant bending stress (Fb) in the rib is also found at the bottom of the tank. At time t=8.52 s, the value for Fb is 83 psi at that location. The largest axial stress (Fa) in the rib is also found within this area, and it has a value of 158 psi compression.

Resultant deformations are measured with respect to the fixed base where the accelerations were applied. At time t=8.52 s, the largest displacement is the vertical translation (Δy) of the top of the tank, which deforms 0.10 in. Other vertical translations and horizontal translations (Δx) are shown in FIG. 14(O).

FIG. 14(P) FE Model V10c7: The FE model V10c7 corresponds to a single underground tank (10-ft diameter) full of gasoline and subjected to vertical seismic accelerations. These accelerations were obtained from records of the 1994 Northridge earthquake, and specifically from the Tarzana station. The modulus of elasticity (E) of the gravel in the model is constant with a value of 30 psi. The damping coefficient is 0.1.

Maximum values of different types of stresses are obtained when the largest displacement (Δy) of 1.43 in. is reached in the soil at time t=8.56 s. The highest resultant hoop stress ($S_{11}$) in the tank shell surface are obtained at the tank bottom. In this area, the maximum surface stress ($S_{11}$), which includes both membrane and bending stresses, is 573 psi tension. In this same area, the highest resultant axial surface stresses ($S_{22}$) of 272 psi compression and 515 psi tension are obtained.

The highest value for resultant bending stress (Fb) in the rib is also found at the bottom of the tank. At time t=8.56 s, the value for Fb is 622 psi in that location. The largest axial stress (Fa) is also found within this area, and it has a value of 71 psi.

Resultant deformations are measured with respect to the fixed base where the accelerations were applied. At time t=8.56 s, the largest displacement is the vertical translation (Δy) of the top of the tank, which deforms 0.69 in. Other vertical translations and horizontal translations (Δx) are shown in FIG. 14(P).

FIG. 14(Q) FE Model V10c8: The FE model V10c8 corresponds to a single underground tank (10-ft diameter) full of gasoline and subjected to vertical seismic accelerations. These accelerations were obtained from records of the 1994 Northridge earthquake, and specifically from the Tarzana station. The modulus of elasticity (E) of the gravel in the model is constant with a value of 300 psi. The damping coefficient is 0.1.

Maximum values of different types of stresses are obtained when the largest displacement (Δy) of 0.333 in. is reached in the soil at time t=8.52 s. The highest resultant hoop stress ($S_{11}$) in the tank shell surface is obtained at the tank bottom. In this area, the maximum surface stress ($S_{11}$), which includes both membrane and bending stresses, is 829 psi compression. In this same area, the highest resultant axial surface stresses ($S_{22}$) of 726 psi compression and 382 psi tension are obtained.

The highest value for resultant bending stress (Fb) in the rib is also found at the bottom of the tank. At time t=8.52 s, the value for Fb is 212 psi in that location. The largest compressive stress (Fa) is also found within this area, and it has a value of 131 psi.

Resultant deformations are measured with respect to the fixed base where the accelerations were applied. At time t=8.52 s, the largest displacement is the vertical translation (Δy) of the top of the tank, which deforms 0.46 in. Other vertical translations and horizontal translations (Δx) are shown in FIG. 14(Q).

FIG. 14(R) FE Model V10b1: The FE model V10b1 corresponds to a single underground empty tank (10-ft diameter) subjected to vertical seismic accelerations. These accelerations were obtained from records of the 1994 Northridge earthquake, and specifically from the Tarzana station. The modulus of elasticity (E) of the gravel in the model varies from 1,008 psi at the top surface to 6,320 psi at the tank's mid-height. From this level to the bottom of the trench, E is constant with a value of 6,320 psi. The damping coefficient is 0.1.

Maximum values of different types of stresses are obtained when the largest displacement (Δy) of 0.044 in. is reached in the soil at time t=8.52 s. The highest resultant hoop stress ($S_{11}$) in the tank shell surface are obtained at the top of the tank. In this area, the maximum surface stress ($S_{11}$), which includes both membrane and bending stresses, is 253 psi compression. In this same area, the highest resultant axial surface stress ($S_{22}$) of 196 psi compression is obtained. The largest tensile ($S_{22}$) stress also occurs at the top of the tank and it has a magnitude of 27 psi.

The highest value for resultant axial stress (Fa) in the rib is found at the bottom of the tank. At time t=8.52 s, the corresponding values for Fb is 126 psi (compression). A maximum bending stress of 23 psi results at the bottom of the tank as shown in FIG. 14(R).

Resultant deformations in both the shell and the rib are very small. At time t=8.52 s, all translations (Δ) are less than 0.04 in. These deformations are relative to the fixed based at the bottom of the trench where the accelerations were applied.

FIG. 14(S) FE Model V10b2: The FE model V10b2 corresponds to a single underground empty tank (10-ft diameter) subjected to vertical seismic accelerations. These accelerations were obtained from records of the 1994 Northridge earthquake, and specifically from the Tarzana station. The modulus of elasticity (E) of the gravel in the model is constant with a value of 100 psi. The damping coefficient is 0.1.

Maximum values of different types of stresses are obtained when the largest displacement (Δy) of 0.768 in. is reached in the soil at time t=8.54 s. The highest resultant hoop stress ($S_{11}$) in the tank shell surface are obtained at the tank bottom. In this area, the maximum surface stress ($S_{11}$), which includes both membrane and bending stresses, is 776 psi compression. The highest resultant axial surface stresses ($S_{22}$) of 694 psi compression and 410 psi tension are obtained near the tank's mid-height.

The highest value for resultant bending stress (Fb) in the rib is found near the bottom of the tank. At time t=8.54 s, the value for Fb is 371 psi at that location.

Resultant deformations are measured with respect to the fixed base where the accelerations were applied. At time t=8.54 s, the largest displacement is the vertical translation (Δy) of the top of the tank, which deforms 0.47 in. Other vertical translations and horizontal translations (Δx) are shown in FIG. 14(S).

FIG. 14(T) FE Model V10b3: The FE model V10b3 corresponds to a single underground empty tank (10-ft diameter) subjected to vertical seismic accelerations. These accelerations were obtained from records of the 1994 Northridge earthquake, and specifically from the Tarzana station. The modulus of elasticity (E) of the gravel in the model is constant with a value of 100 psi from the tank's mid-height to the bottom of the trench, and E varies from 1,008 psi at the top surface to 6,238 psi at the level of the tank's mid-height. The damping coefficient is 0.1.

Maximum values of different types of stresses are obtained when the largest displacement (Δy) of 0.44 in. is reached in the soil at time t=8.52 s. The highest resultant hoop stresses ($S_{11}$) in the tank shell surface are obtained at the tank bottom. In this area, the maximum surface stress ($S_{11}$), which includes both membrane and bending stresses, is 1,015 psi compression. In this same area, the highest resultant axial surface stresses ($S_{22}$) of 870 psi compression and 492 psi tension are obtained.

The highest value for resultant bending stress (Fb) in the rib is found near the mid-height of the tank. At time t=8.52 s, the value for Fb is 655 psi in that location. The largest compressive stress (Fa) is also found near the tank's mid-height, and it has a value of 190 psi. Additional values for Fa and Fb are shown in FIG. 14(T).

Resultant deformations are measured with respect to the fixed base where the accelerations were applied. At time t=8.52 S, the largest displacement is the vertical translation ($\Delta y$) of the top of the tank, which deforms 0.40 in. Other vertical translations ($\Delta y$) and horizontal translations ($\Delta x$) are shown in FIG. 14(T).

A method for modeling the behavior of an underground structure such as an underground storage tank under dynamic loads has been described. The method may be used to model any rib-reinforced geometric structure, regardless of what material the structure is constructed. The method involves constructing separate finite element models for the ribs, tank and fill material. The fill material model comprises a plurality of three-dimensional solid "brick" elements. The tank model comprises a plurality of three dimensional plate/shell elements. The rib model comprises a plurality of beam elements. The nodal points for the beam elements correspond to nodes defining one edge of the tank shell. The tank/rib model is joined to the soil model through a plurality of radial link elements between the brick and shell elements. Spring elements may also be added for stability. A dynamic vertical or horizontal forcing function is then applied to the model. Stress and/or displacement results from horizontal and vertical forcing functions may then be combined if desired. The forcing functions are preferably taken from an actual earthquake, although simulated forcing functions may also be used.

While the invention has been described in detail in connection with the preferred embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

What is claimed is:

1. A computerized method for evaluating the behavior of an underground structure having reinforcing ribs and a shell during seismic events, the method comprising the steps of:

creating a finite element model of the shell;

creating a finite element model of a rib;

creating a finite element model of backfill material surrounding the structure;

joining the models of the rib, shell and backfill, directly or indirectly, to form a system model; and applying at least one forcing function to the system model to produce behavioral data corresponding to a physical effect on the structure resulting from the forcing function.

2. The method of claim 1, wherein the backfill material model comprises a plurality of three dimensional brick elements, each brick element having a plurality of brick element nodes.

3. The method of claim 1, wherein the rib model comprises a plurality of beam elements, each beam element having a plurality of beam element nodes.

4. The method of claim 1, wherein the shell model comprises a plurality of three dimensional shell plate elements, each shell plate element having a plurality of shell plate element nodes.

5. The method of claim 1, wherein the backfill material model comprises a plurality of three dimensional brick elements, each brick element having a plurality of brick element nodes, the rib model comprises a plurality of beam elements, each beam element having a plurality of beam element nodes, and the shell model comprises a plurality of three dimensional shell plate elements, each shell plate element having a plurality of shell plate element nodes.

6. The method of claim 5, wherein the rib model corresponds to one half of an actual rib and the plate model corresponds to one half of the plate material between adjacent ribs of the structure.

7. The method of claim 6, wherein a pair of beam element nodes corresponds to a pair of shell plate element nodes.

8. The method of claim 7, further comprising the step of joining the shell model to the backfill model by a plurality of radial link elements between brick and shell plate elements.

9. The method of claim 8, further comprising the step of joining the shell model to the backfill model with at least one spring element having a tangential component.

10. The method of claim 9, wherein the forcing function represents a vertical force.

11. The method of claim 10, wherein the vertical force represents a vertical force measured during an actual earthquake.

12. The method of claim 9, wherein the forcing function represents a horizontal force.

13. The method of claim 10, wherein the vertical force represents a horizontal force measured during an actual earthquake.

14. The method of claim 10, further comprising the step of modeling a concrete slab with a plurality of concrete slab plate elements, at least one of the concrete slab plate elements being joined to a respective brick element.

15. The method of claim 14, further comprising the step of restraining translation of brick element nodes corresponding to the concrete slab in an axial direction of the structure.

16. The method of claim 10, wherein the backfill material has a vertical edge spaced apart from the structure, further comprising the step of restraining all translations and rotations, except for vertical translations, of all brick nodes corresponding to the vertical edge of the backfill material.

17. The method of claim 10, wherein the backfill material has a bottom spaced apart from the structure, further comprising the step of restraining all translations of brick element nodes corresponding to the backfill material bottom.

18. The method of claim 1, wherein the applying step is performed once for a forcing function representing a vertical force, once for a forcing function representing a horizontal force, further comprising the step of combining at least one result associated with the horizontal force with at least one result associated with the vertical force.

19. The method of claim 1, wherein the structure is a storage tank.

20. The method of claim 1, wherein the physical effect is displacement.

21. The method of claim 1, wherein the physical effect is stress.

22. A computerized method for evaluating the behavior of an underground storage tank during an earthquake, the underground storage tank having a shell and a plurality of ribs, the underground storage tank being buried in a trench backfilled with a backfill material, the method comprising the steps of:

creating a finite element model of a portion of the shell;

creating a finite element model of a portion of a rib, the rib model sharing a plurality of nodes with the shell model;

creating a finite element model of the backfill material;

joining the backfill model to at least one of the rib model and the shell model to create a system model; and applying a forcing function to the system model to produce behavioral data corresponding to a physical effect on the structure resulting from the forcing function.

23. The method of claim 22, wherein the forcing function represents forces resulting from an actual earthquake.

24. The method of claim 22, further comprising the step of adjusting the weight densities of the shell plate elements to account for the forces applied to the shell by contents of the tank.

25. The method of claim 22, wherein the physical effect is displacement.

26. The method of claim 22, wherein the physical effect is stress.

27. A computerized method for evaluating the behavior of an underground structure during seismic events, the method comprising the steps of:

creating a model of the structure; and applying a forcing function to the model, the forcing function representing force resulting from an actual earthquake measured in at least one direction, and calculating at least one physical effect resulting from the forcing function, the physical effect being selected from the group consisting of a stress on the structure and a displacement of the structure.

* * * * *